US007306486B2

(12) United States Patent
Takeda et al.

(10) Patent No.: US 7,306,486 B2
(45) Date of Patent: Dec. 11, 2007

(54) CONNECTOR

(75) Inventors: Kazuaki Takeda, Yokkaichi (JP); Tomoyoshi Fukaya, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/641,156

(22) Filed: Dec. 19, 2006

(65) Prior Publication Data

US 2007/0141905 A1 Jun. 21, 2007

(30) Foreign Application Priority Data

Dec. 20, 2005 (JP) ..... 2005-366725

(51) Int. Cl.
*H01R 13/40* (2006.01)

(52) U.S. Cl. ..... 439/594; 439/352

(58) Field of Classification Search ..... 439/352, 439/351, 353, 355, 571, 272
See application file for complete search history.

(56) References Cited

U.S. PATENT DOCUMENTS 5,628,648 A 5/1997 Higgins, Jr. et al.
5,688,142 A 11/1997 Dietz et al.
6,077,117 A * 6/2000 Iwahori ..... 439/595
6,276,964 B1 8/2001 Shinozaki
6,364,718 B1 4/2002 Polgar et al.
6,494,732 B2 * 12/2002 Kashiyama et al. ..... 439/352
6,948,978 B2 * 9/2005 Itou et al. ..... 439/595
6,971,906 B2 * 12/2005 Yamaoka ..... 439/489
7,033,201 B2 * 4/2006 Ichida et al. ..... 439/352
2003/0162413 A1 8/2003 Shinozaki et al.

* cited by examiner

*Primary Examiner*—James R. Harvey
*Assistant Examiner*—Travis Chambers
(74) *Attorney, Agent, or Firm*—Gerald E. Hespos; Anthony J. Casella

(57) ABSTRACT

A connector has a housing (12) and a frame (15). The housing (12) has a wall (58) and a lock (19) that is resiliently deformable outward in the thickness direction of the wall (58). The lock (19) engages an interlocking portion (18) in the frame (15) when the housing (12) and the frame (15) are connected properly. A bracket (16) is inserted into a deformation area (62) for the lock (19) to prevent deformation of the lock (19). Thus, the lock (19) remains engaged with the interlocking portion (18) even if a force acts in a direction to separate the housing (12) and the frame (15).

10 Claims, 24 Drawing Sheets

CONNECTOR

BACKGROUND OF THE INVENTION

1. Field of the Invention

The invention relates to a connector.

2. Description of the Related Art

U.S. Pat. No. 6,276,964 discloses a connector with two housings that are connectable one inside the other. A side wall of the outer housing has a resilient lock that is deformable outward in the thickness direction of the side wall. The lock engages an interlocking portion on the inner housing to hold the two housings together. A strong force in a direction to separate the housings could deform the lock sufficiently out in the thickness direction of the side wall to disengage the lock from the interlocking portion, thereby separating the two housings.

The invention was developed in view of the above problem and an object thereof is to provide a connector with an increased interlocking force between the two housings.

SUMMARY OF THE INVENTION

The invention relates to a connector with two housings that are connectable so that one is at least partly inside the other. At least one resilient lock is provided at a side wall of the outer housing and is deformable out in the thickness direction of the side wall. At least one interlocking portion is formed at the inner housing and is engageable with the lock to hold the housings together. At least one engaging portion is provided at the side wall of the outer housing, and is engageable with at least one locking section of a bracket. The bracket is inserted into a deformation area for the lock while the locking section of the bracket and the engaging portion of the outer housing are engaged. The bracket prevents outward deformation of the lock in the thickness direction of the side wall of the outer housing when the locking section of the bracket and the engaging portion of the outer housing are engaged. As a result, the lock and the interlocking portion will not disengage even if a strong force acts in a direction to separate the housings.

Two guide rails preferably are formed on the side wall of the outer housing and project out in the thickness direction of the side wall. The guide rails preferably are at opposite sides of the lock and/or the engaging portion and the bracket is insertable between the guide rails.

The height of the guide rails from the side wall preferably exceeds the heights of the lock and the engaging portion from the side wall. Thus, external matter is not likely to collide with the lock and the engaging portion.

The lock preferably is cantilevered between slits in the side wall of the outer housing and extends along an inserting direction of the bracket. Accordingly, an outward deformation of the base end of the lock in the thickness direction of the side wall of the outer housing is prevented since the bracket is inserted between the guide rails from the side of the base end of the lock. As a result, the two housings can be locked together more securely.

At least one excessive deformation preventing piece preferably is provided on the side wall for preventing an excessive deformation of the lock. The excessive deformation preventing piece preferably covers the lock and spans between the guide rails.

The lock could be pressed out excessively by an outer wall of the inner housing if the inner housing is fit in obliquely. A plastically deformed lock might not engage the interlocking portion completely, and the locking force of the two housings may be reduced. However, the excessive deformation preventing piece at least partly covers the lock from the outer side to prevent excessive deformation of the lock even if the lock is pressed out by an excessive force. Thus, the locking force of the two housings is not reduced.

At least one collision preventing rib preferably projects in on the inner surface of the side wall of the outer housing and extends from a connection surface of the outer housing along a connecting direction. The rib is engageable with at least one guiding groove formed in an outer surface of a side wall of the inner housing. Accordingly, a collision resulting from an oblique posture of the inner housing can be prevented during the connection.

The collision preventing rib preferably extends to the inner surface of the lock, and reinforces the lock. Accordingly, the connector can be smaller as compared to a case where a separate reinforcement is provided for the lock.

The inner housing preferably comprises a frame for receiving one or more auxiliary connectors. A partial connection detector may be provided for detecting partial connection of the auxiliary connectors and the inner housing.

The outer housing preferably has notches for receiving finger placing portions for allowing an operation of the outer housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
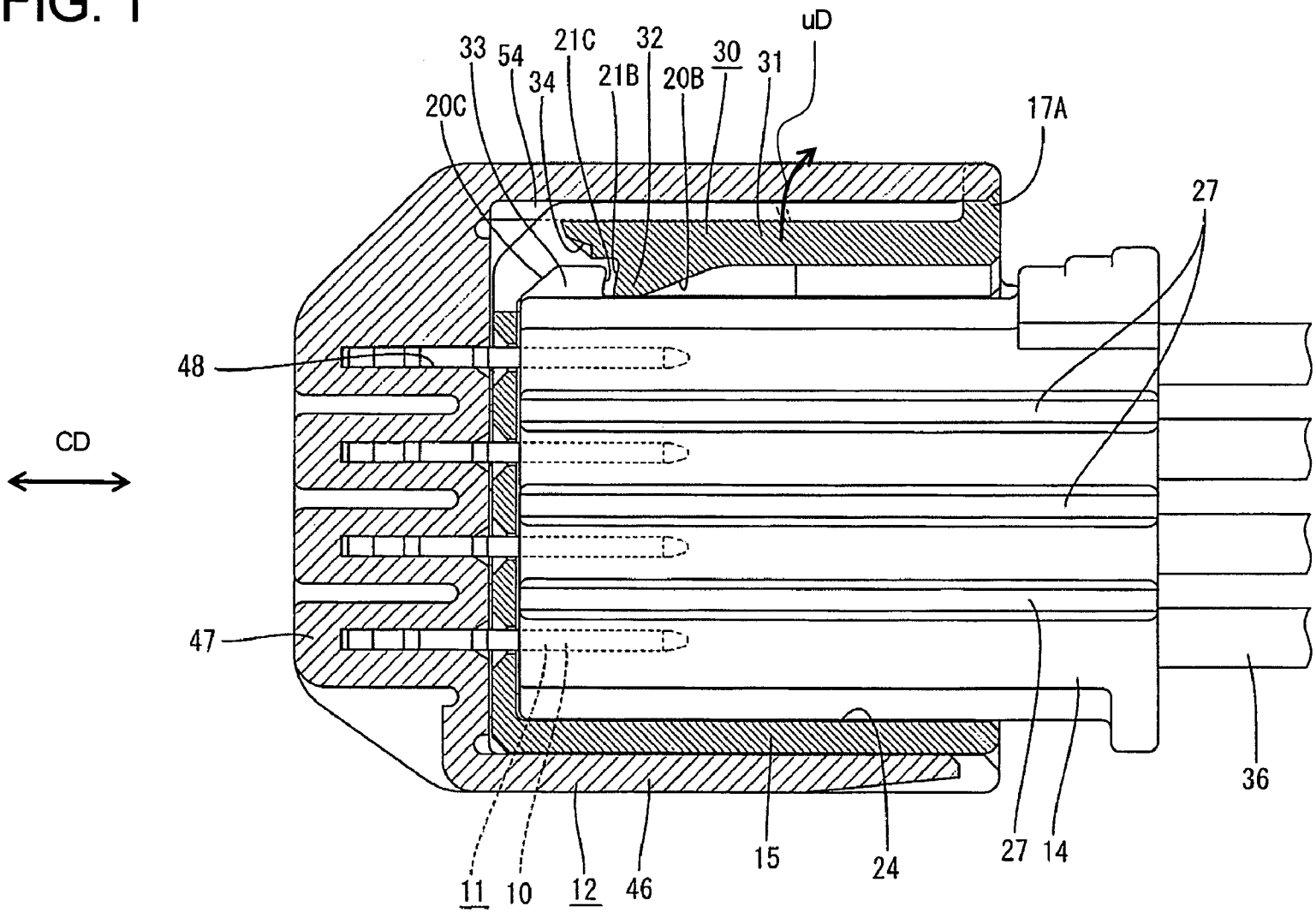
FIG. 1 is a vertical section of a connector of a first embodiment.

A connector according to a first embodiment of the invention is described with reference to FIGS. 1 to 23. The connector of this embodiment has male tabs 10 formed on busbars 11 that are accommodated in a male housing 12. The connector also includes female terminal fittings 13 that are accommodated in auxiliary connectors 14. The auxiliary connectors 14 are received in a female frame 15 that is connectable with the male housing 12. The male housing 12 is located outside the female frame 15 when the male housing 12 and the female frame 15 are connected properly. The male housing 12 is mountable to an unillustrated fixed body via a bracket 16 on the fixed body. In the following description, connecting directions CD the male housing 12 and the female frame 15 are referred to as forward directions and reference is made to FIG. 1 concerning the vertical direction.

The female frame 15 is made e.g. of a synthetic resin and is substantially in the form of a block. Finger placing portions 17A project out from the opposite left and right ends of the rear edge of the upper wall of the female frame 15 in FIG. 8. Further, at least one finger placing portion 17B projects down from a position near the transverse center of the rear edge of the bottom wall of the female frame 15 in FIG. 8. Thus, an operator can easily hold the finger placing portions 17A, 17B by the fingers to separate the female frame 15 from the male housing 12.

Figure 5:
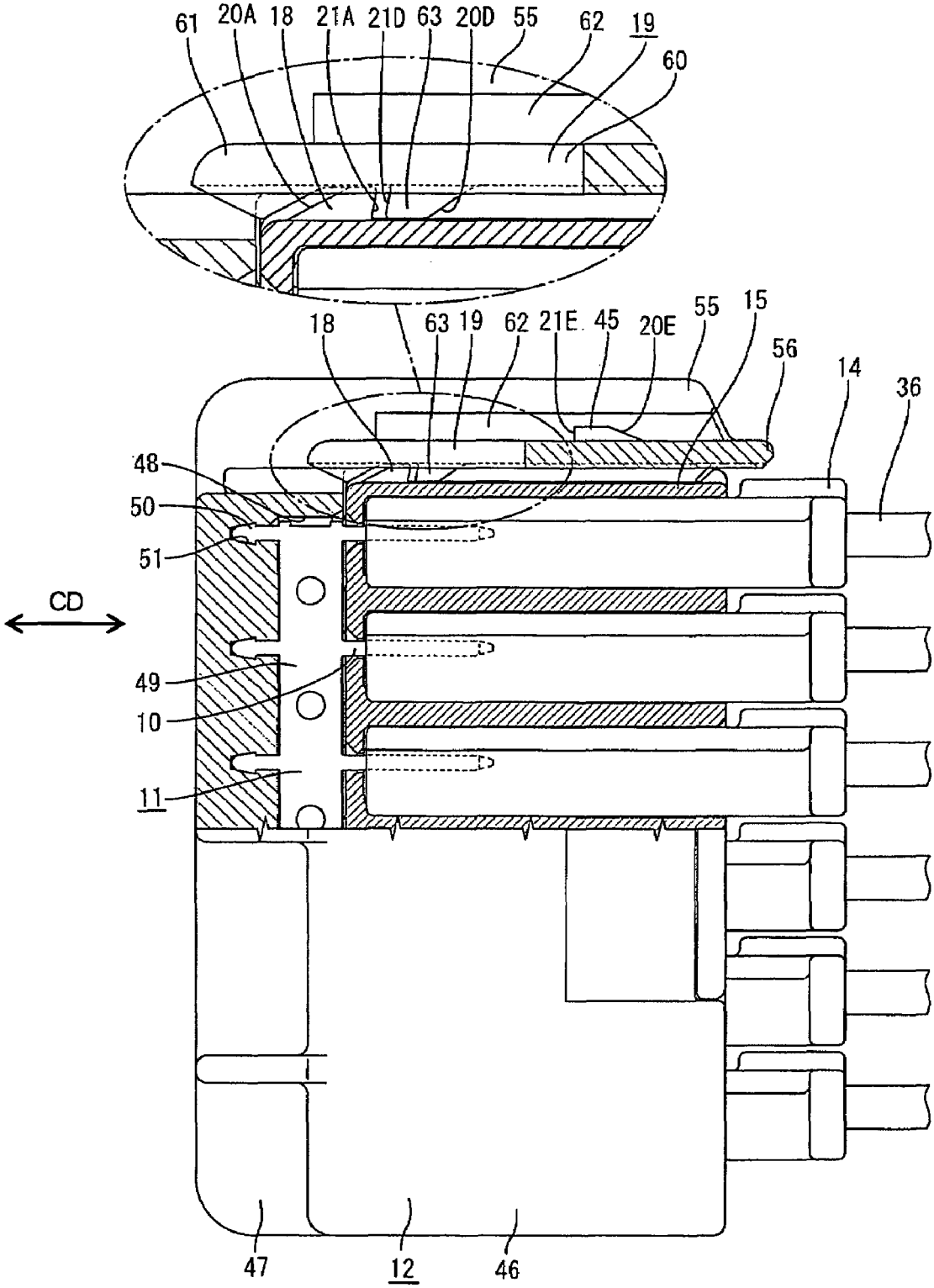
FIG. 5 is a bottom view partly in section of the connector.
Figure 7:
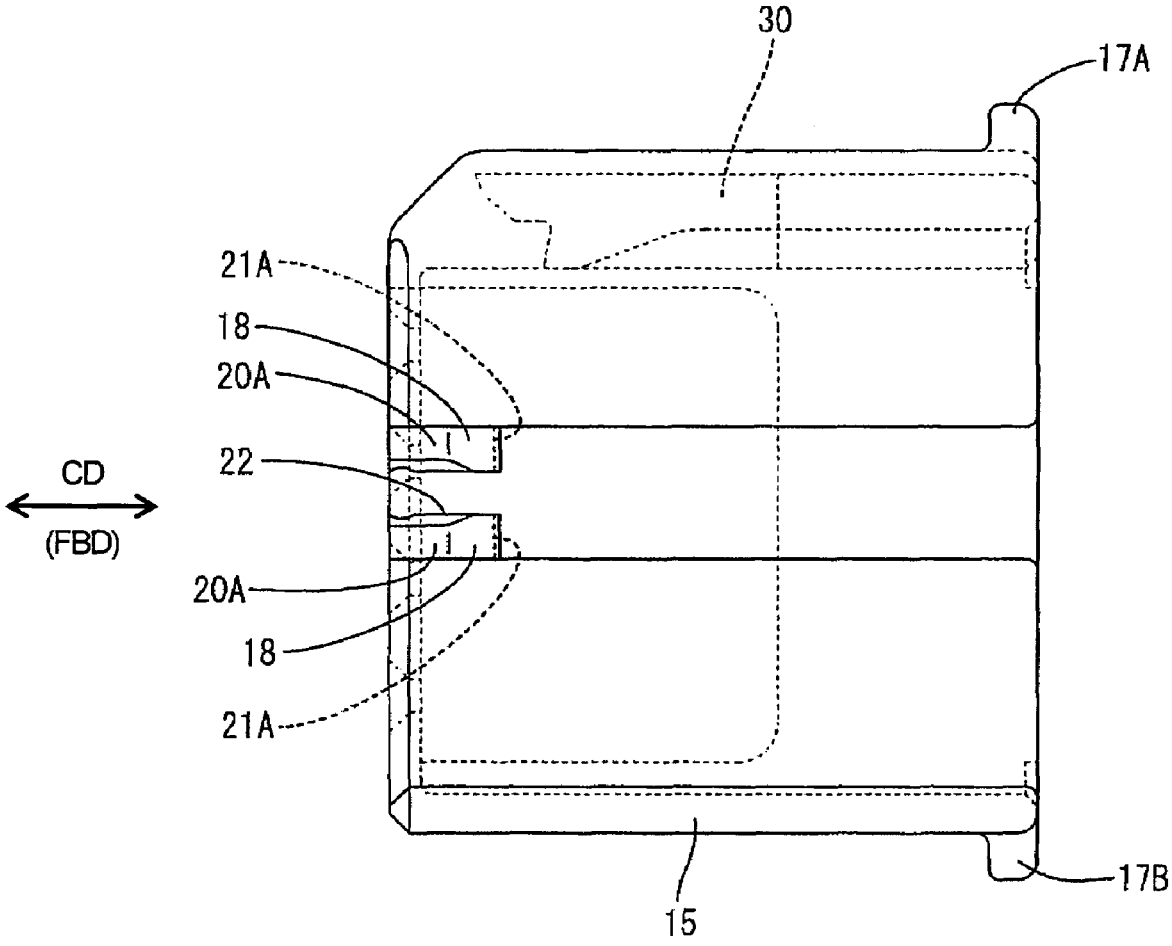
FIG. 7 is a side view of a female frame.
Figure 8:
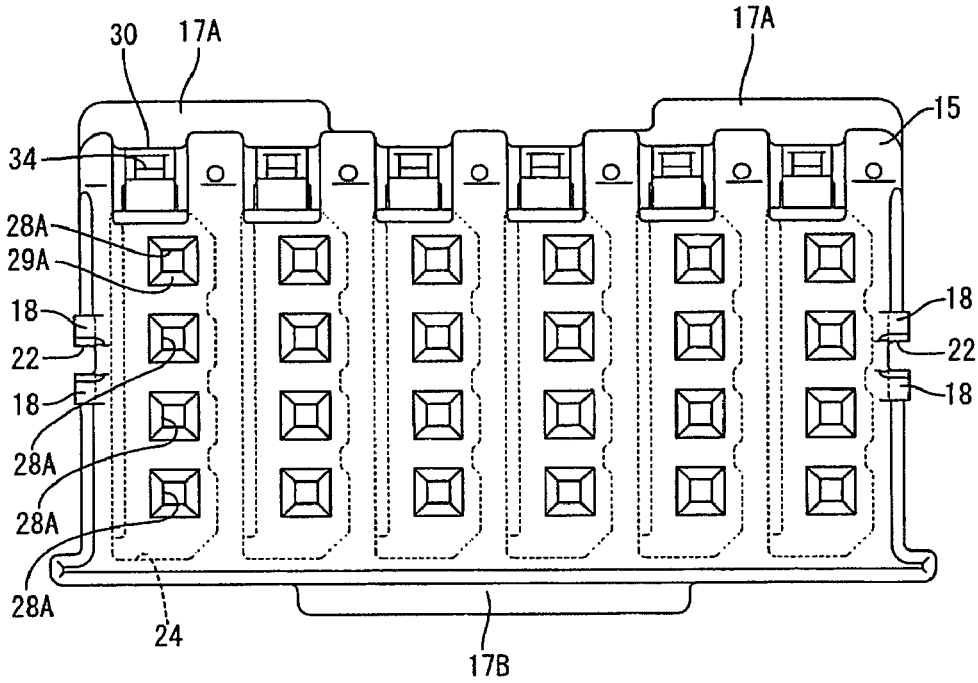
FIG. 8 is a front view of the female frame.
Figure 9:
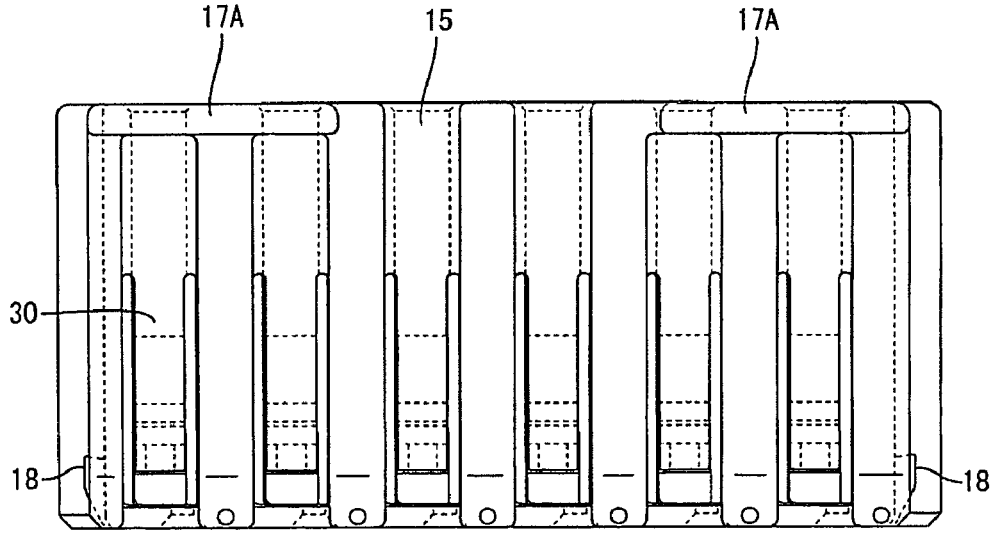
FIG. 9 is a plan view of the female frame.

Interlocking portions 18 project transversely out from intermediate positions near the vertical centers of the opposite left and right walls of the female frame 15, as shown in FIG. 8, and are engageable with locks 19 of the male housing 12. As shown in FIG. 5, the front surface of each interlocking portion 18 is slanted for facilitating a movement of the lock 19 onto the interlocking portion 18. A locking surface 21A is formed at the rear of the interlocking portion 18 and is inclined slightly back towards its projecting end. As shown in FIG. 7, a guiding groove 22 is formed near a vertical middle position of each interlocking portion 18 and extends in forward and backward directions FBD. The guiding grooves 22 engage collision preventing ribs 23 of the male housing 12 so that the female frame 15 cannot enter the male housing 12 in an inclined posture. Thus, the front end of the female frame 15 will not collide with the male tabs 10.

Figure 10:
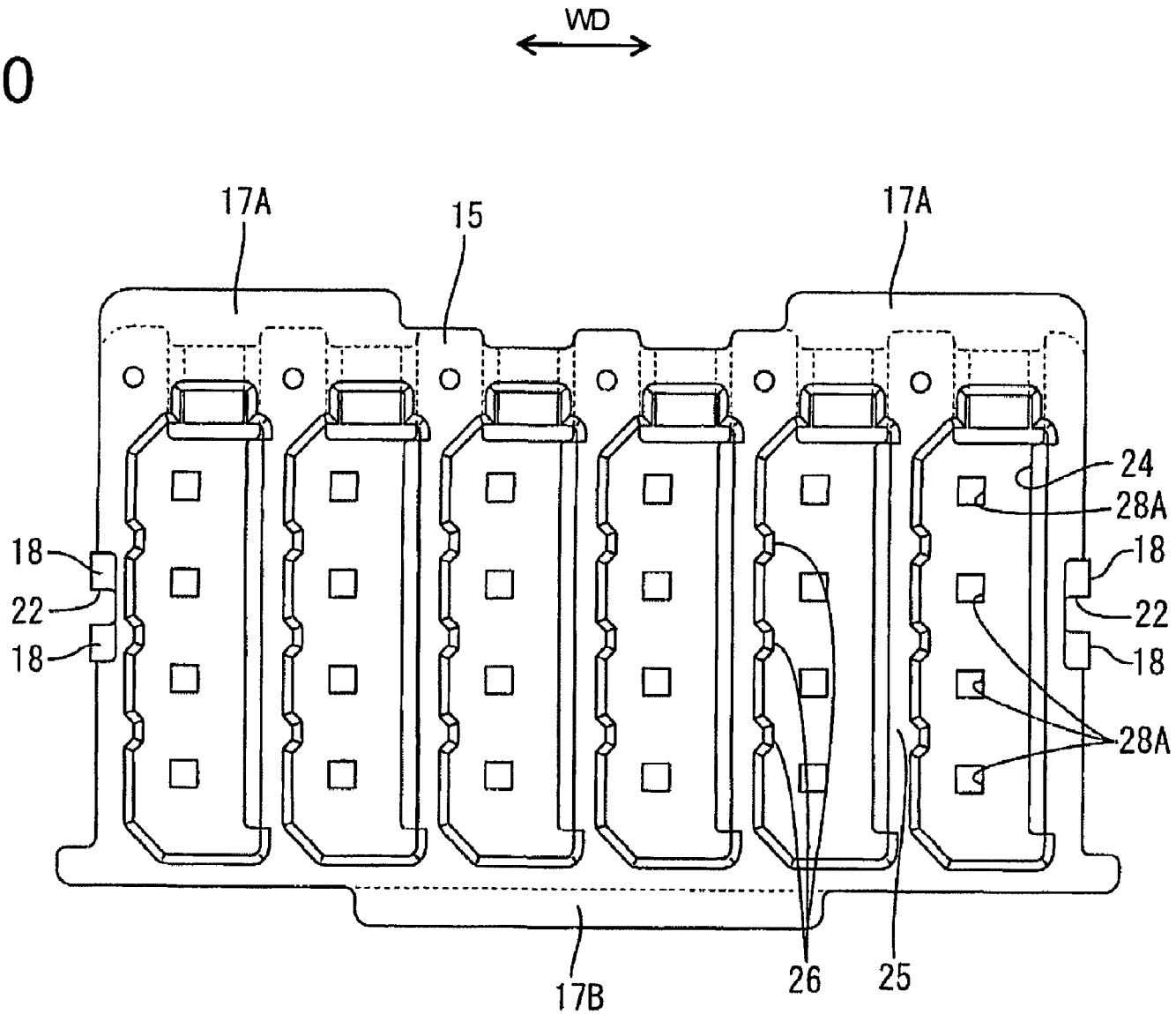
FIG. 10 is a rear view of the female frame.

As shown in FIG. 10, accommodating chambers 24 are formed in the female frame 15 for receiving the auxiliary connectors 14 from behind. The accommodating chambers 24 are arranged side by side along the width direction WD and open in the rear of the female frame 15. Each accommodating chamber 24 is long and narrow along a vertical direction that is normal to the width direction WD, and partition walls 25 separate adjacent accommodating chambers 24. Ribs 26 project in from the left wall of each accommodating chamber 24 in FIG. 10. The ribs 26 extend forward from the rear edge of the female frame 15, and engage guiding grooves 27 in the auxiliary connectors 14 to guide the auxiliary connectors 14 into the accommodating chambers 24. Male tab insertion holes 28A are formed one above another in the front wall of each accommodating chamber 24 for receiving male tabs 10. A slanted surface 29A is formed at the opening edge of each male tab insertion hole 28A, as shown in FIG. 8, for guiding the insertion of the male tab 10.

A frame side lock 30 is formed in the ceiling wall of each accommodating chamber 24 and cantilevers forward, as shown in FIG. 1. Parts of the female frame 15 before the frame side locks 30 are cut off for receiving a disengagement jig (not shown). The jig can deform the frame side locks 30 in an unlocking direction UD that is normal to the connecting direction CD for separating the female frame 15 from the male housing 12.

A resiliently deformable arm 31 is defined at the free front end of each frame side lock 30. A locking projection 32 projects from the lower surface of the arm 31 and into the accommodating chamber 24 at a position slightly retracted from the front end. The locking projection 32 is engageable with a partial lock 33 of the auxiliary connector 14 for retaining the auxiliary connector 14 at a proper position in the accommodating chamber 24. An inclined surface 20B is formed at the rear of the locking projection 32 so that the locking projection 32 can move easily onto the partial lock 33 of the auxiliary connector 14, whereas a locking surface 21B is formed at the front of the locking projection 33 and inclines towards the back. A disengagement recess 34 is formed in the front end surface of the arm 31 for receiving the leading end of the disengagement jig (not shown) for forcibly deforming the frame side lock 30. The front end surface of the arm 31 inclines up and out towards the front, so that a portion defined between the upper surface and the front end surface of the arm 31 has a pointed configuration.

Each auxiliary connector 14 is made e.g. of a synthetic resin and has a flat shape with a small dimension in the width direction WD, as shown in FIGS. 11 to 14. The partial lock 33 projects out and up near the front end (right end in FIG. 13) of the upper wall of the auxiliary connector 14. An inclined surface 20C is formed at the front of the partial lock 33 so that the locking projection 32 of the frame side lock 30 can move easily onto the partial lock 33. A locking surface 21C is formed at the rear of the partial lock 33 and inclines back towards the top. The auxiliary connector 14 can be inserted into the accommodating chamber 24 of the female frame 15 from behind. As a result, the inclined surface 20C of the partial lock 33 of the auxiliary connector 14 slides in contact with the inclined surface 20B of the locking projection 32 of the frame side lock 30. Accordingly, the frame side lock 30 deforms up and out in the unlocking direction UD. The locking projection 32 of the frame side lock 30 moves over the partial lock 33 of the auxiliary connector 14 and the frame side lock 30 resiliently restores when the auxiliary connector 14 is inserted properly inserted. As a result, the locking surface 21B of the locking projection 32 of the frame side lock 30 contacts the locking surface 21C of the partial lock 33 of the auxiliary connector 14 from behind. In this way, the auxiliary connector 14 is prevented from coming out backward (see FIG. 1).

Figure 11:
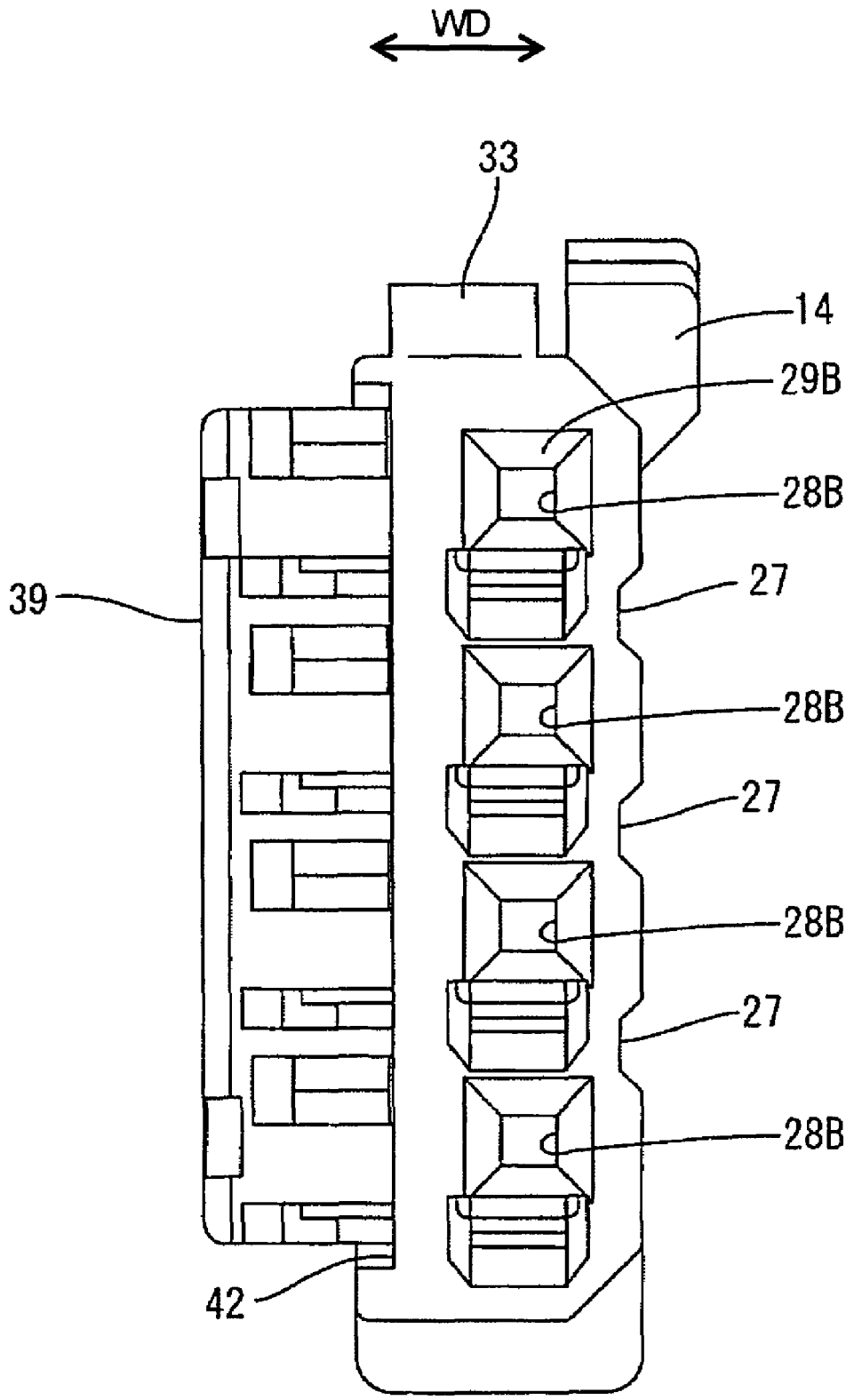
FIG. 11 is a front view of an auxiliary connector showing a state where a retainer is not accommodated in a retainer accommodating hole.
Figure 14:
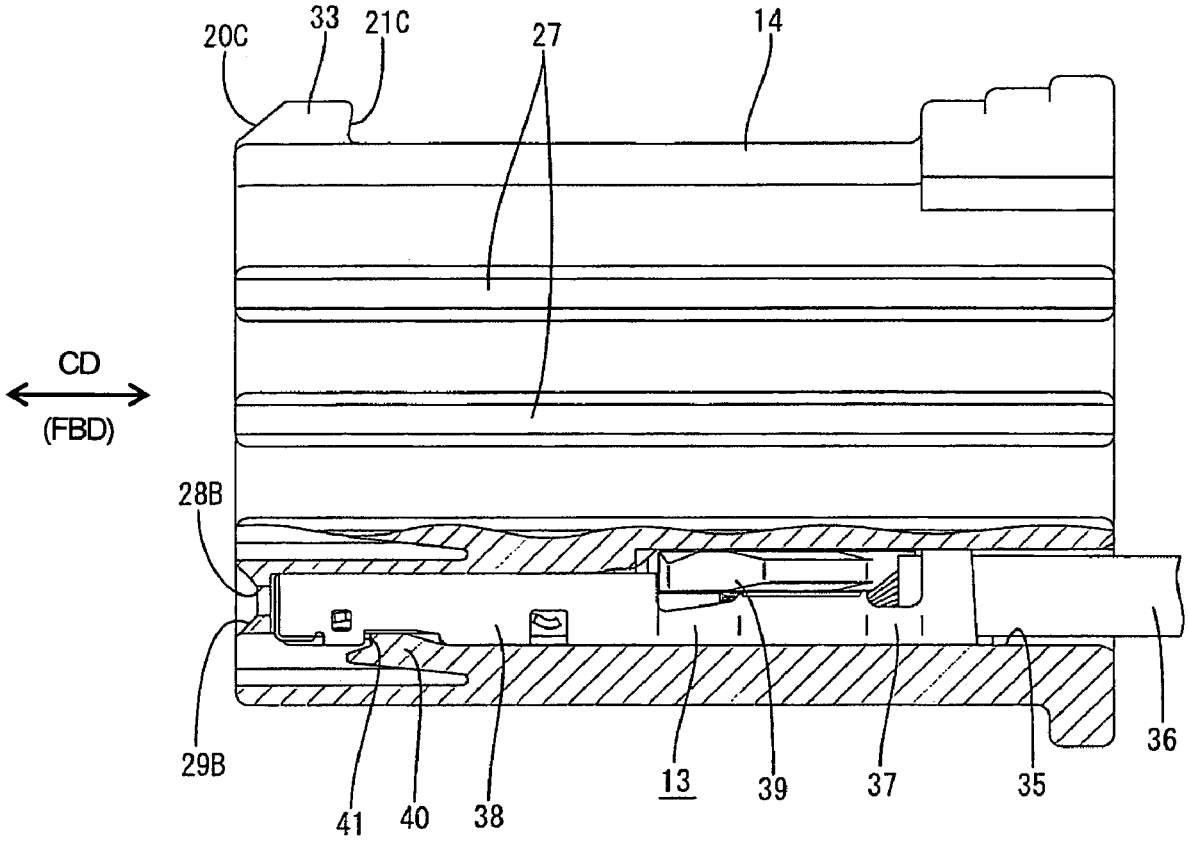
FIG. 14 is a side view partly in section showing a surface of the auxiliary connector opposite to the one where the retainer is formed.
Figure 15:
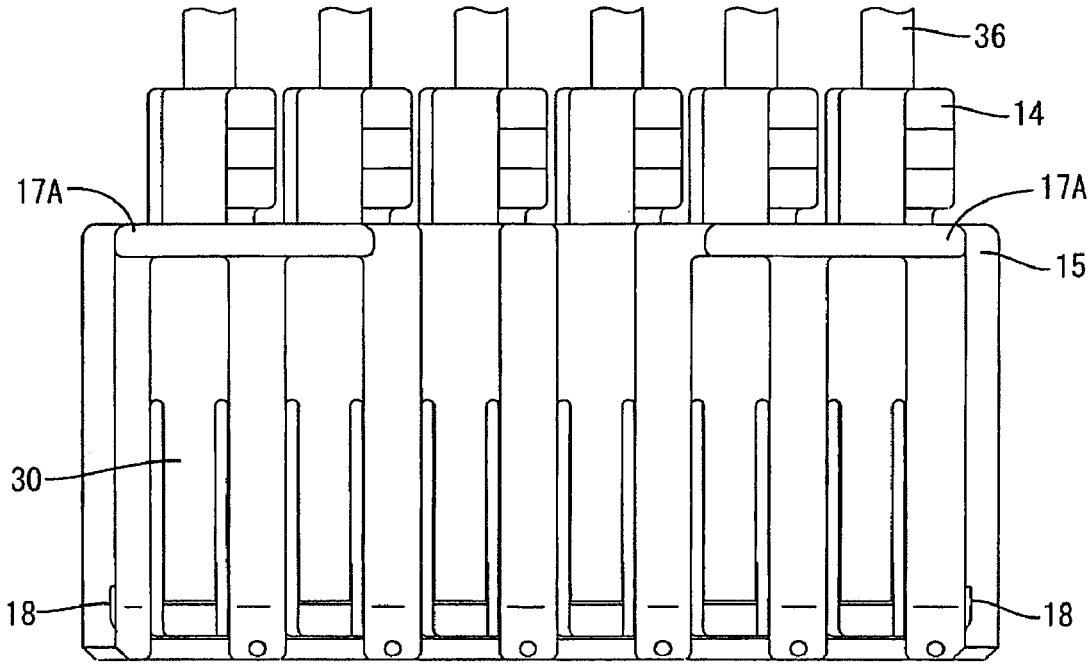
FIG. 15 is a plan view showing a state where the auxiliary connectors are inserted in the female frame.

As shown in FIG. 14, four cavities 35 are formed in each auxiliary connector 14 for accommodating the female terminal fittings 13 that are connected to ends of wires 36. The cavities 35 are formed one above another in the vertical direction in FIG. 14 and extend in forward and backward directions FBD (transversely in FIG. 14). Each female terminal fitting 13 includes a barrel 37 to be crimped, bent or folded into connection with the wire 36. A connecting tube 38 is formed before the barrel 37 and is designed to establish electrical connection with the busbar 11 by insertion of the male tab 10 therein. A locking hole 41 is formed in the bottom wall of the connecting tube 38. A retainer 39 is engaged with the rear edges of the connecting tubes 38 for double locking when the female terminal fittings 13 are inserted properly. As shown in FIG. 11, a male tab insertion hole 28B is formed in the front wall of each cavity 35 for receiving the male tab 10, and a tapered surface 29B is formed at the opening edge of each male tab insertion hole 28B for guiding the insertion of the male tab 10.

The auxiliary-connector side lock 40 is cantilevered forward from the bottom wall of each cavity 35 and is engageable with the locking hole 41 of the female terminal fitting 13 to prevent the female terminal fitting 13 from coming out backward.

A retainer 39 is cantilevered forward (right in FIG. 13) from a lateral wall 42 of each auxiliary connector 14 (left wall in FIGS. 11 and 12), and is pivotal about the base end thereof. A retainer accommodating hole (not shown) is formed in the lateral wall 42 of the auxiliary connector 14 for accommodating the retainer 39. The retainer 39 can engage the edge of the retainer accommodating hole to hold the retainer 39 in the retainer accommodating hole. Additionally, the retainer 39 engages the rear edges of the connecting tubes 38 of the female terminal fittings 13 from behind when the retainer is in the retainer accommodating hole. Thus, the retainer 39 cooperates with the auxiliary-connector side locks 40 (see FIG. 14) for doubly locking the female terminal fittings 13.

Figure 12:
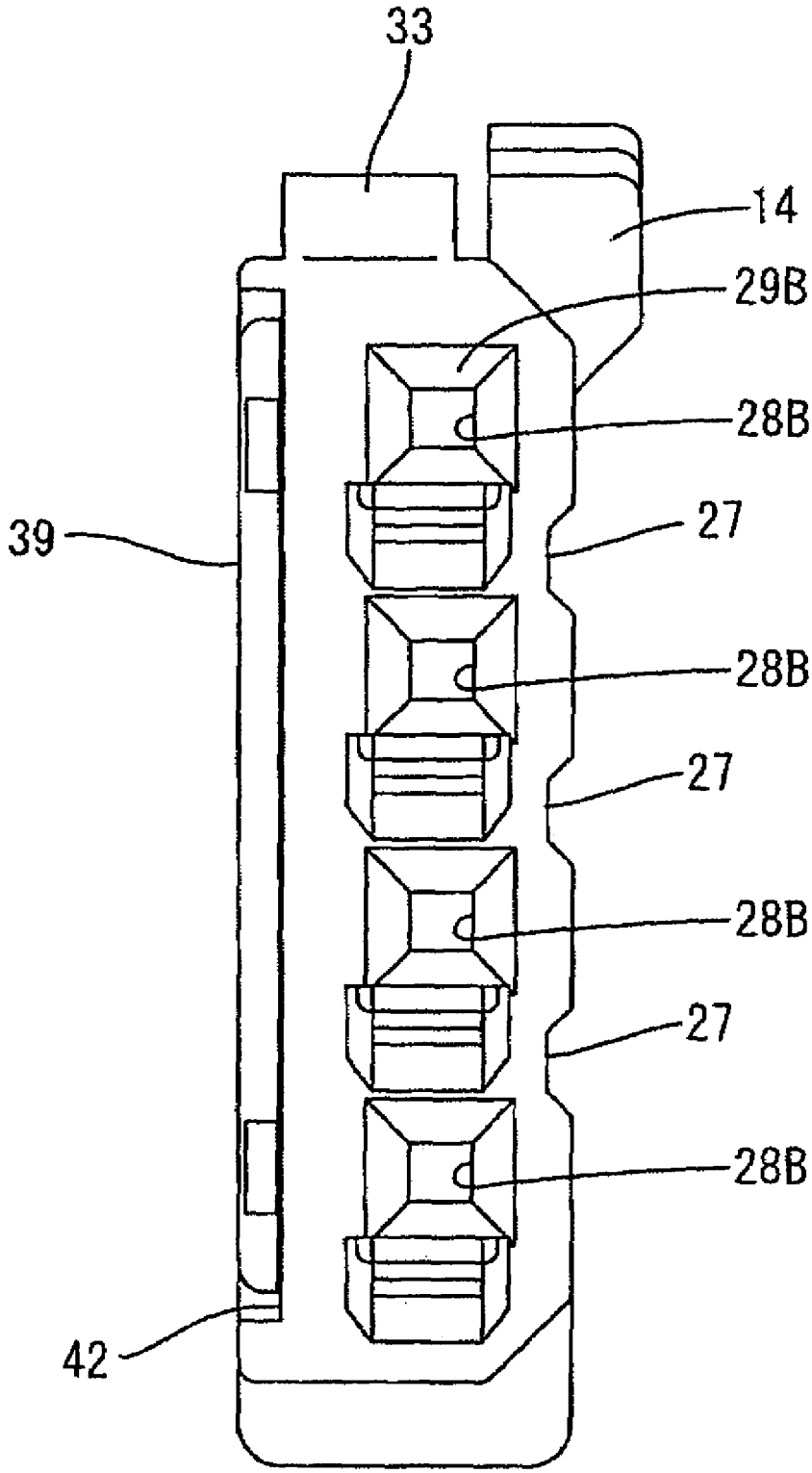
FIG. 12 is a front view of the auxiliary connector showing a state where the retainer is accommodated in the retainer accommodating hole.
Figure 13:
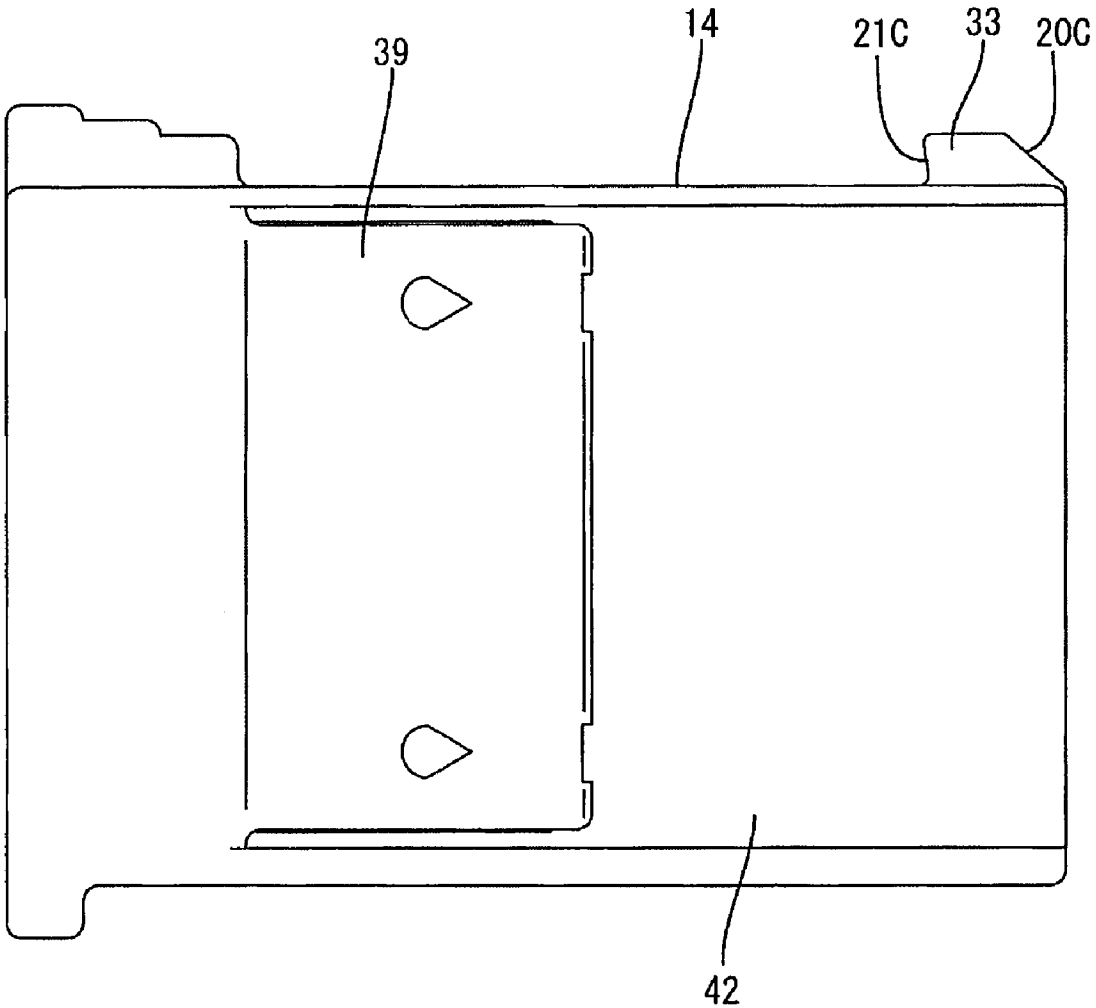
FIG. 13 is a side view showing a side surface of the auxiliary connector where the retainer is formed.

Three guiding grooves 27 extend in forward and backward directions FBD along the right wall of each auxiliary connector 14, as shown in FIGS. 11 and 12. The guiding grooves 27 are disposed one above another and are engageable with the ribs 26 of the female frame 15.

Figure 6:
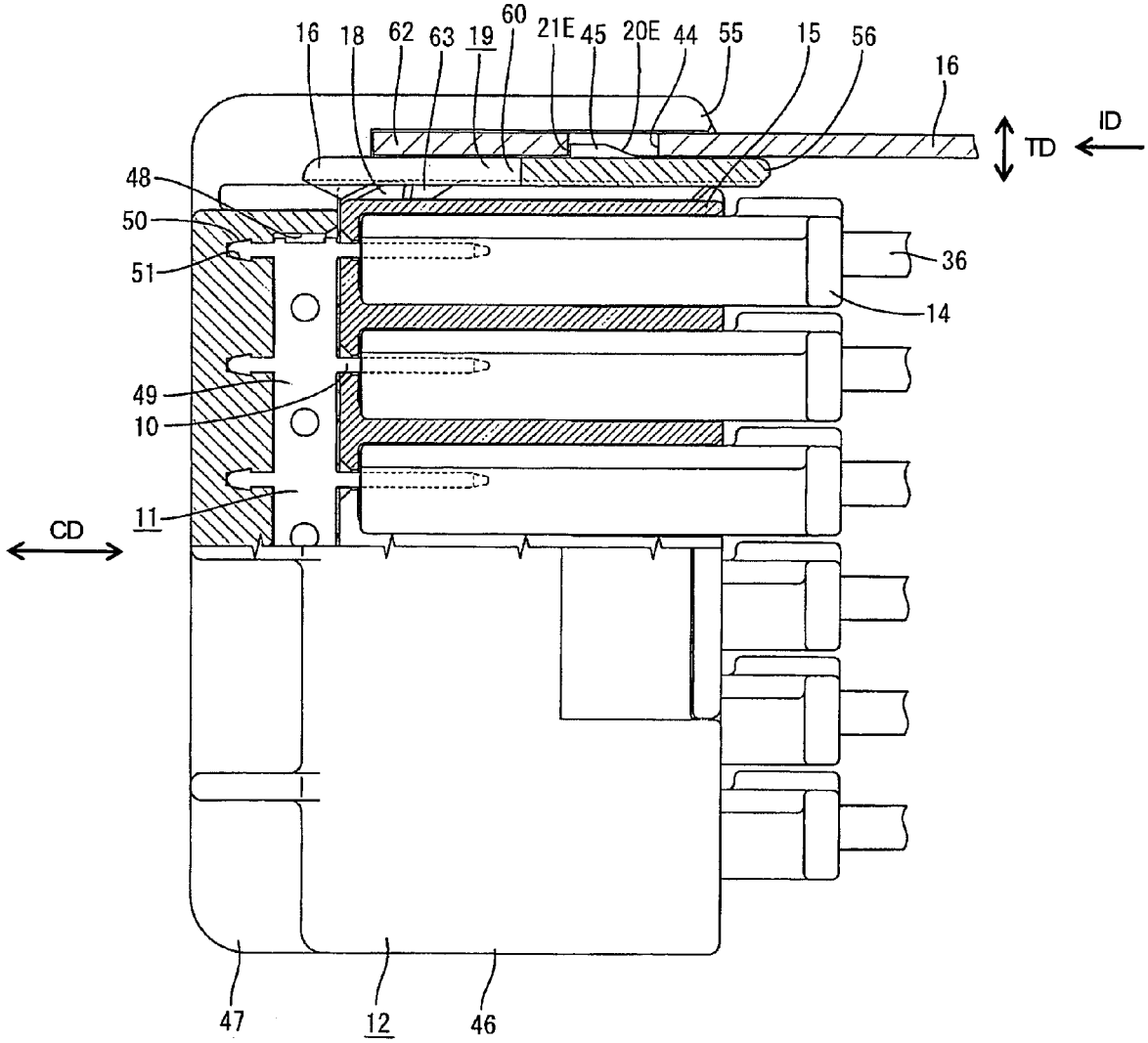
FIG. 6 is a bottom view partly in section showing a state where a bracket is assembled into the connector.

As shown in FIG. 6, the bracket 16 is a rigid metal plate and is to be provided on an unillustrated fixing body used to mount the connector. At least one locking section 44 penetrates the bracket 16 in thickness direction TD, and engages an engaging portion 45 of the male housing 12.

The male housing 12 is made e.g. of a synthetic resin and includes a receptacle 46 with an open front and a busbar holding portion 47 behind the receptacle 46, as shown in FIG. 1. Busbar holding grooves 48 are formed one above another in a back surface of the receptacle 46 of the busbar holding portion 47 exposed at the back of the receptacle 46 and extend in the width direction WD, as shown in FIG. 16.

Figure 21:
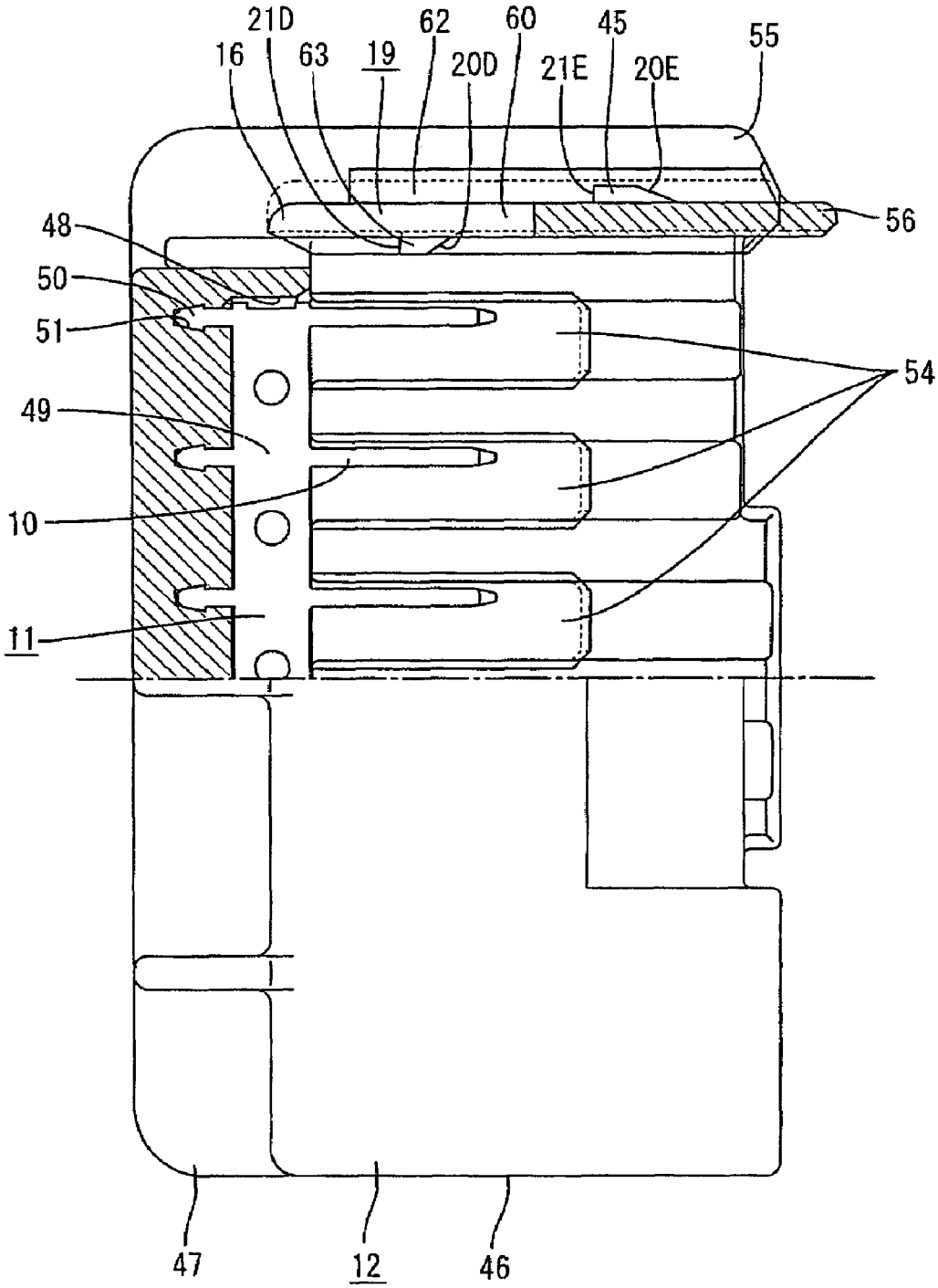
FIG. 21 is a bottom view partly in section of the male housing showing a lock portion and partial connection detecting ribs.

Each busbar 11 is formed by punching, cutting or stamping a conductive metallic plate and includes male tabs 10, as shown in FIG. 21. A coupling 49 couples the male tabs 10 and fixing portions 50 project from a side of the coupling 49 opposite the male tabs 10. The coupling 49 is accommodated in the busbar holding groove 48 and the fixing portions 50 are pressed into fixing holes 51 in the busbar holding groove 48 to hold each busbar 11 in the corresponding busbar holding groove 48. The male tabs 10 project into the receptacle 46 when the coupling 49 is fixed in the busbar holding groove 48.

Figure 2:
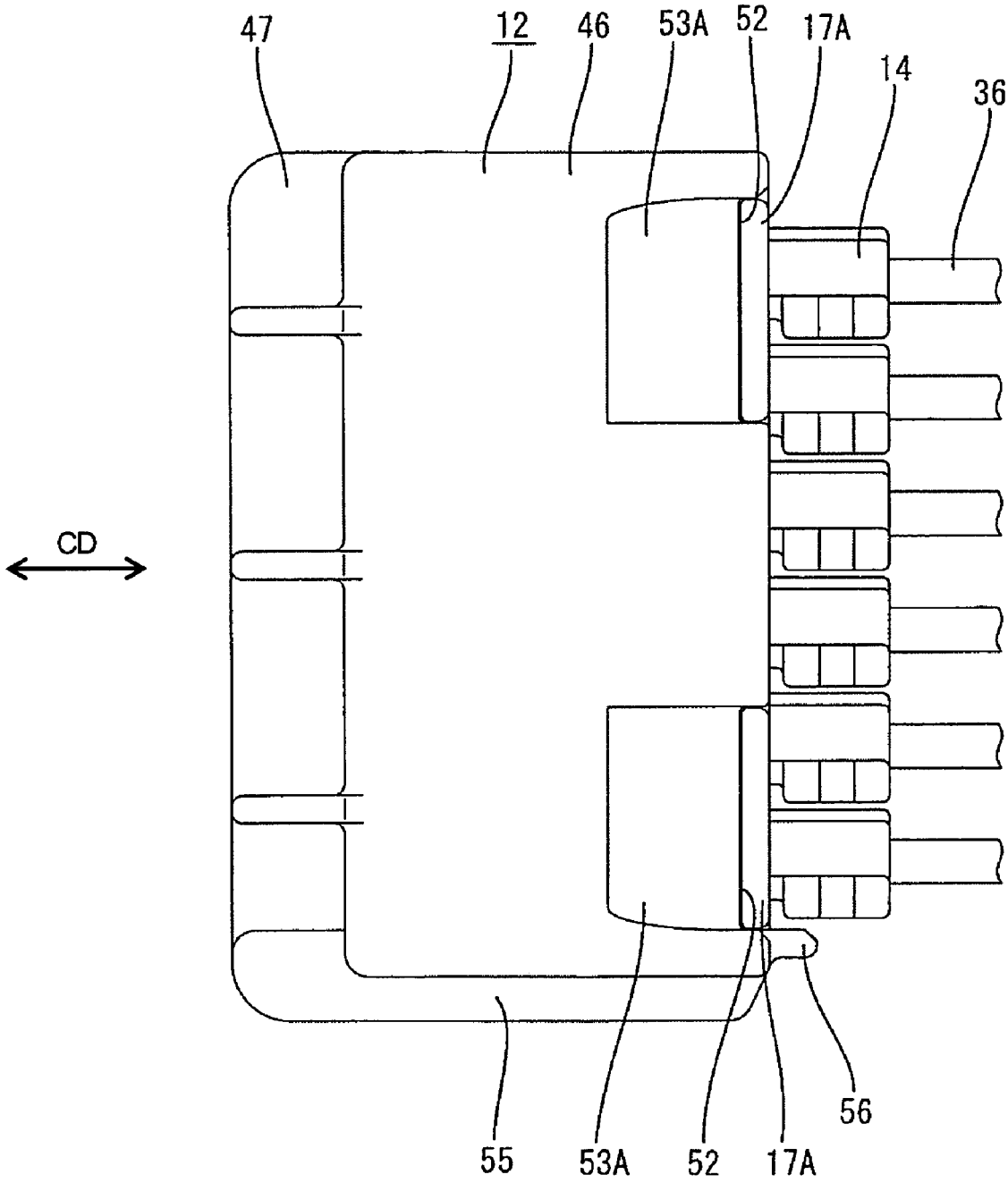
FIG. 2 is a plan view of the connector.
Figure 18:
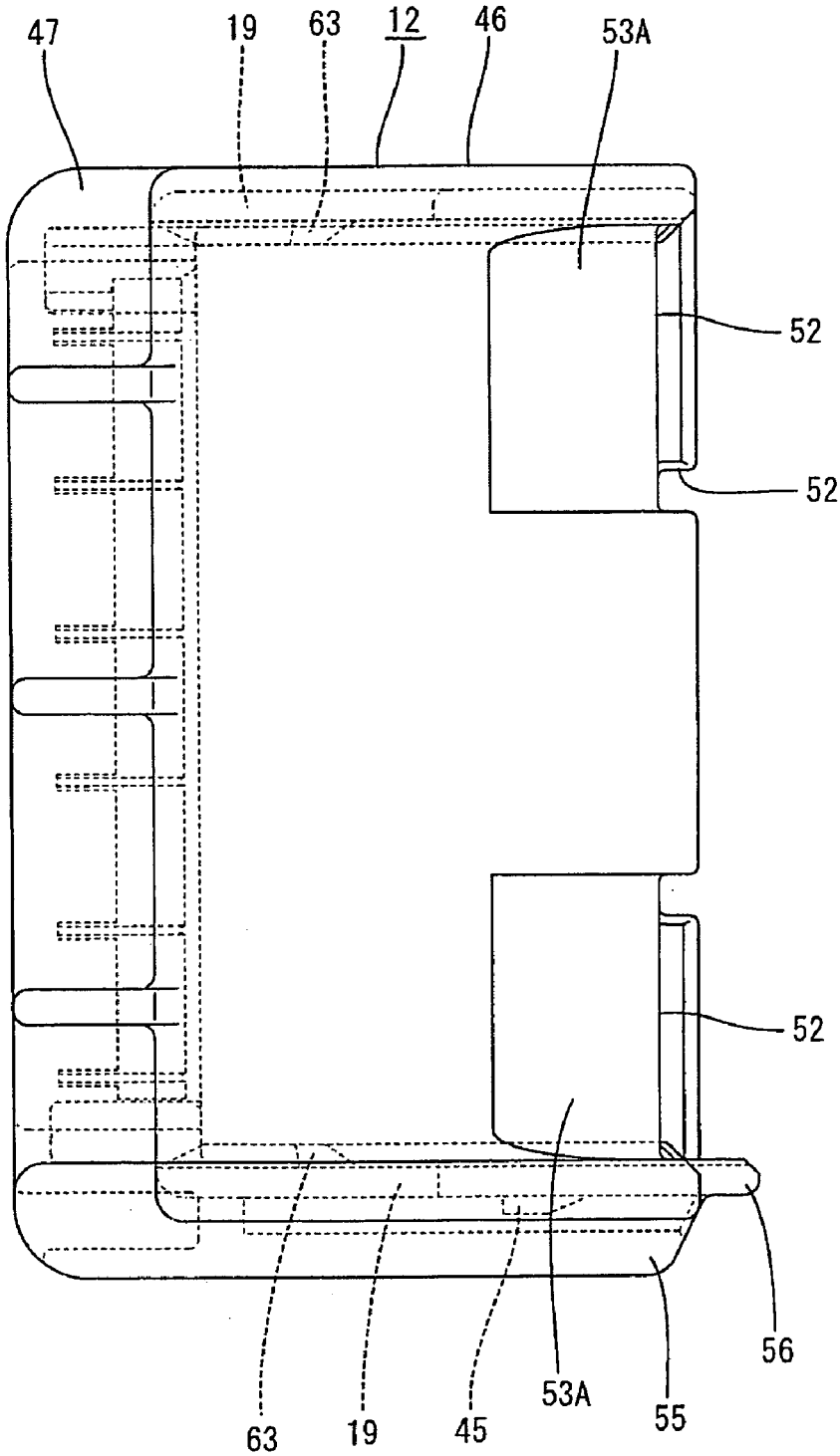
FIG. 18 is a plan view of the male housing.

Lateral ends of the front edge of the ceiling wall of the receptacle 46 are recessed to form notches 52, as shown in FIG. 18. A dimension of each notch 52 in forward and backward directions FBD substantially equals the thickness of the finger placing portions 17A of the female frame 15. As shown in FIG. 2, finger placing slants 53A slope out and up toward the back in the outer surface of the ceiling wall of the receptacle 46 to extend from the notches 52. Upper ends of the finger placing portions 17A project from the front edges of the finger placing slants 53A when the male housing 12 and the female frame 15 are connected properly, thereby making it easier for an operator to place his fingers on the finger placing portion 17A.

Figure 3:
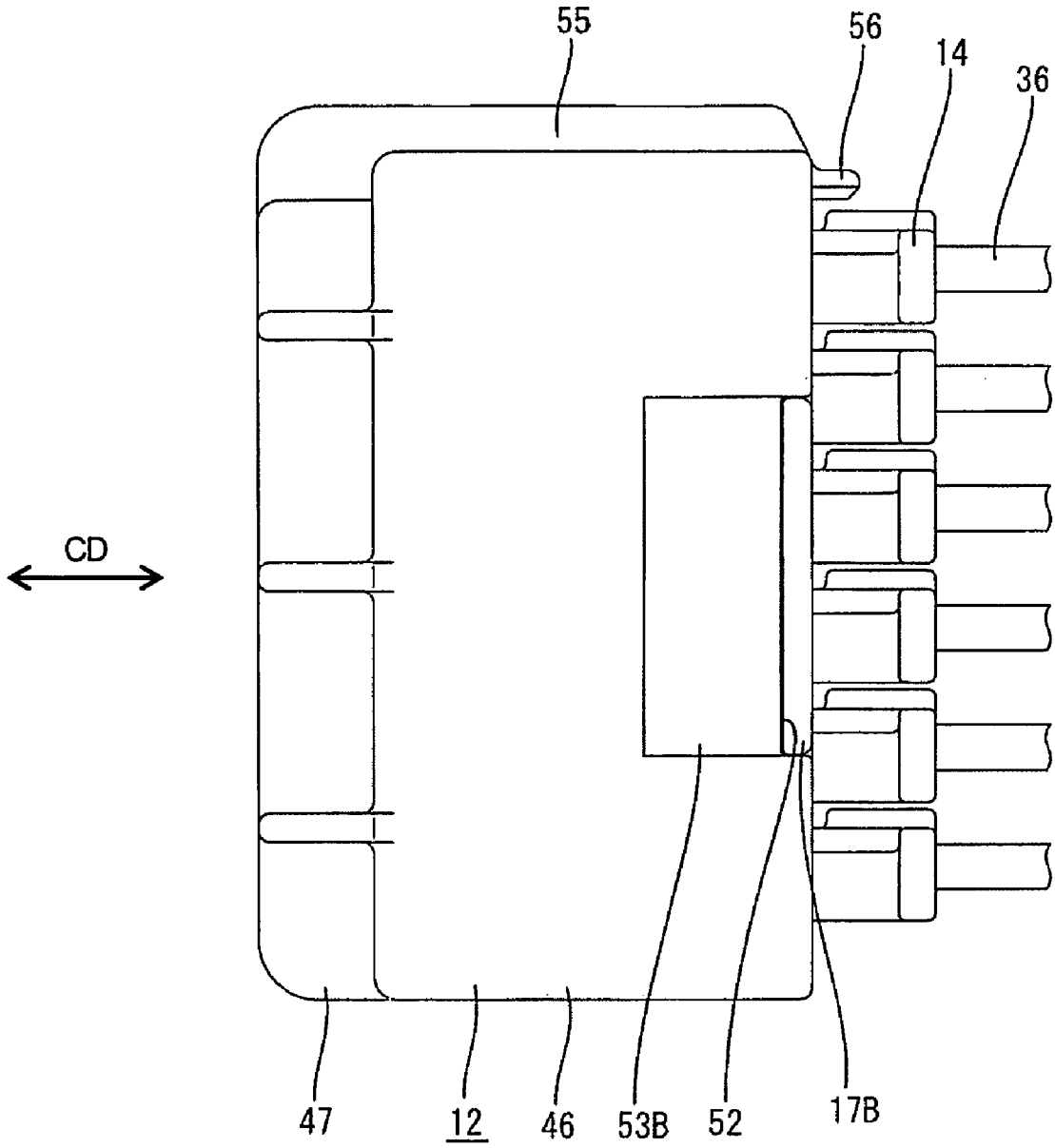
FIG. 3 is a bottom view of the connector.
Figure 16:
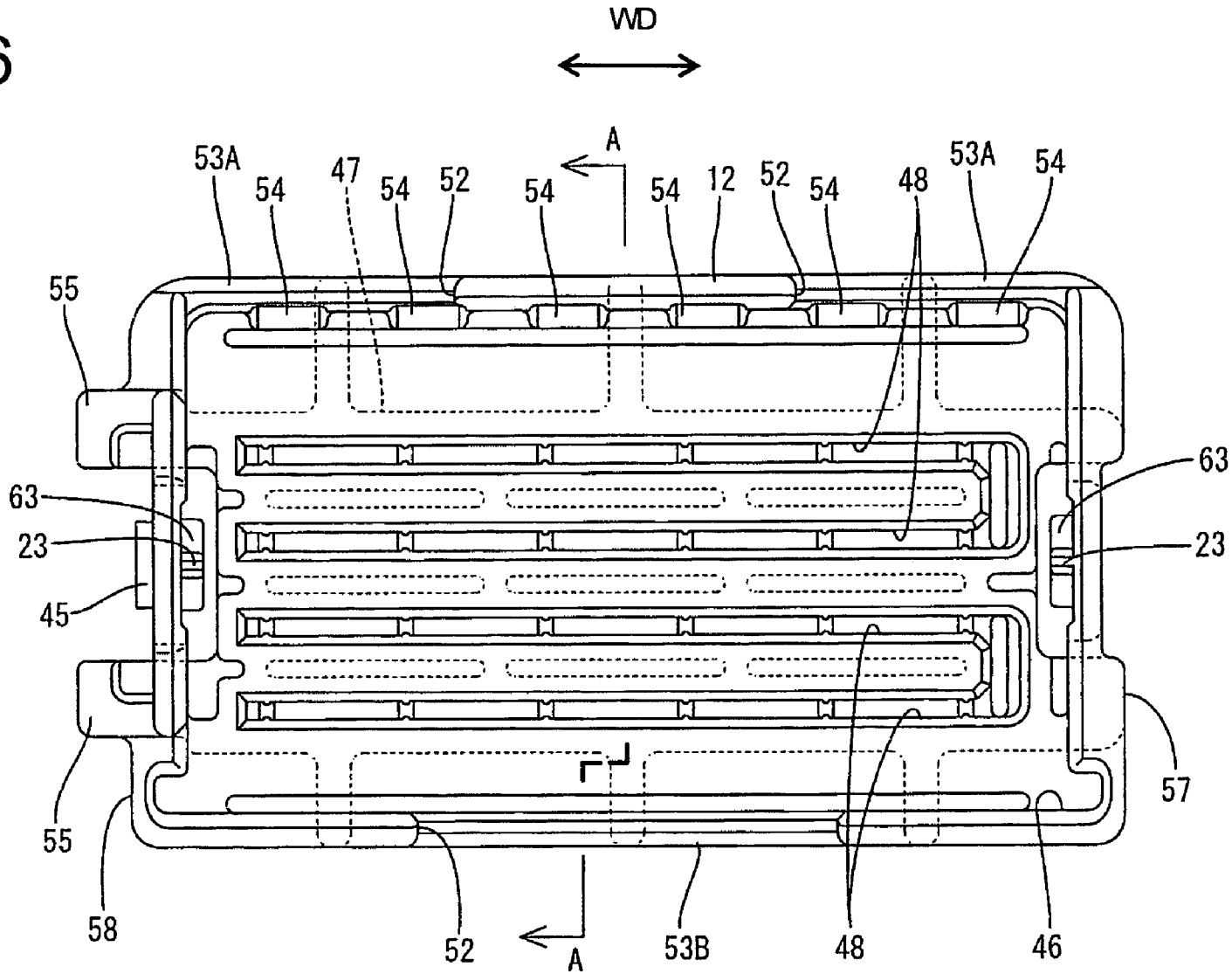
FIG. 16 is a front view of a male housing.
Figure 17:
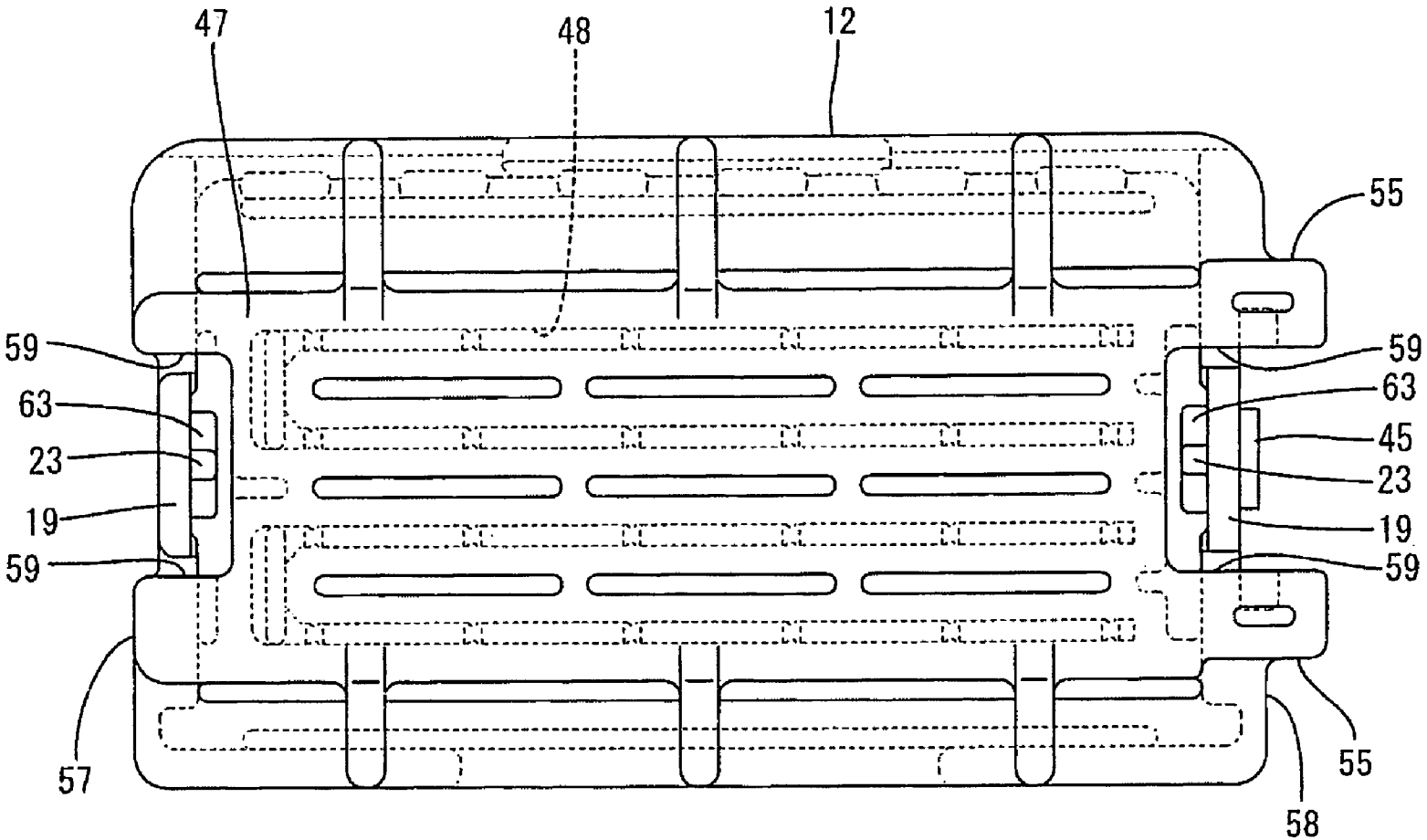
FIG. 17 is a rear view of the male housing.

A notch 52 is recessed at an intermediate position on the front edge of the bottom wall of the receptacle 46, as shown in FIGS. 3, 16 and 18. A dimension of the notch 52 in forward and backward directions FBD substantially equals the thickness of the finger placing portion 17B of the female frame 15. As shown in FIG. 3, a finger placing slant 53B slopes back to the notch 52 in the outer surface of the bottom wall of the receptacle 46. The bottom end of the finger placing portion 17B projects from the front edge of the finger placing slant 53B when the male housing 12 and the female frame 15 are connected properly to facilitate placement of a finger on the finger placing portion 17B.

Figure 4:
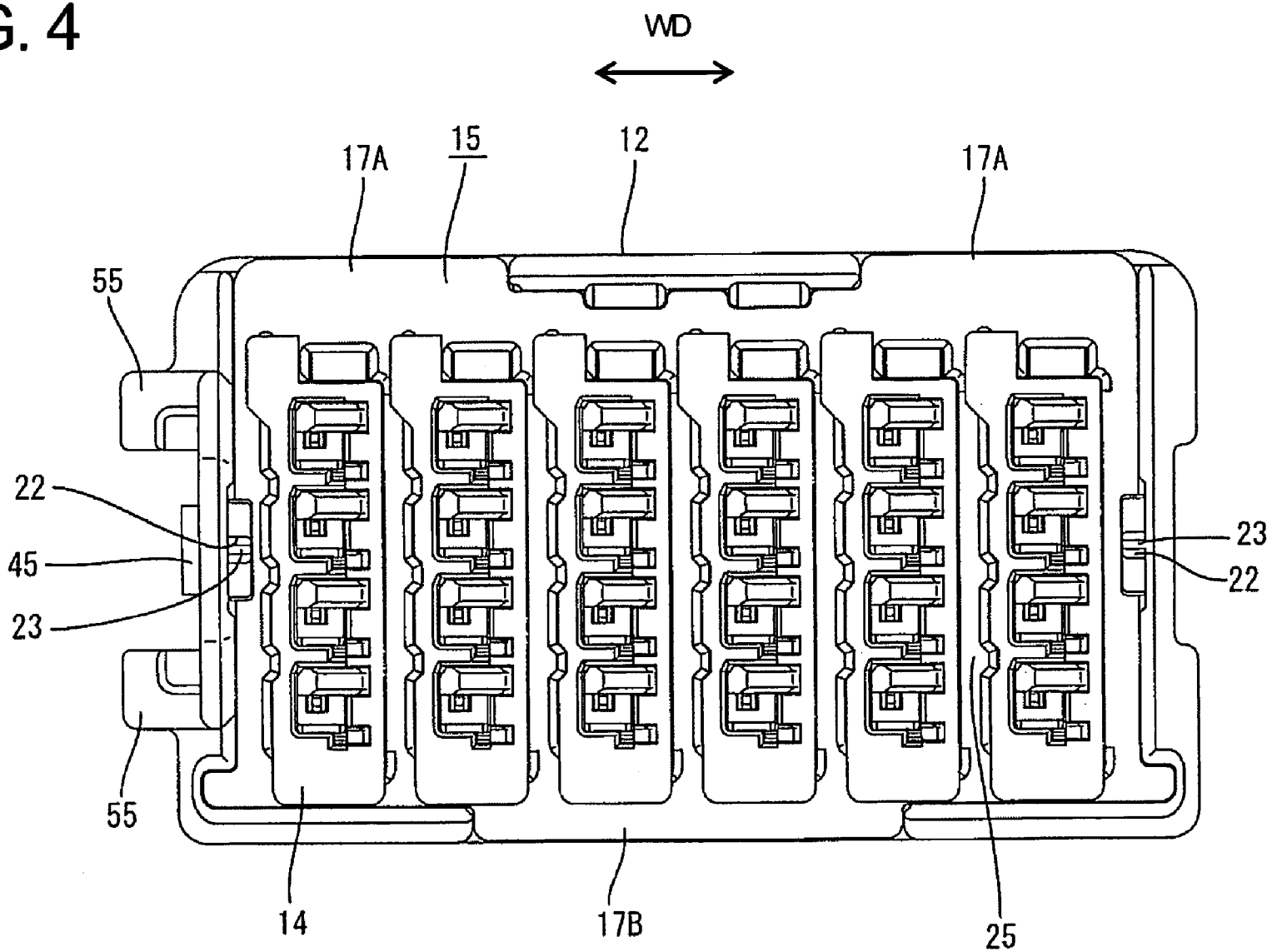
FIG. 4 is a rear view of the connector without wires and female terminal fittings.

As shown in FIG. 1, the rear end surface of the female frame 15 and the front end surface of the male housing 12 are substantially flush with each other when the female frame 15 and the male housing 12 are connected properly. Further, as shown in FIG. 4, the upper ends of the finger placing portions 17A of the female frame 15 and the bottom end of the finger placing portion 17B are substantially flush with the respective upper and bottom surfaces of the male housing 12 when the female frame 15 and the male housing 12 are connected properly.

Figure 22:
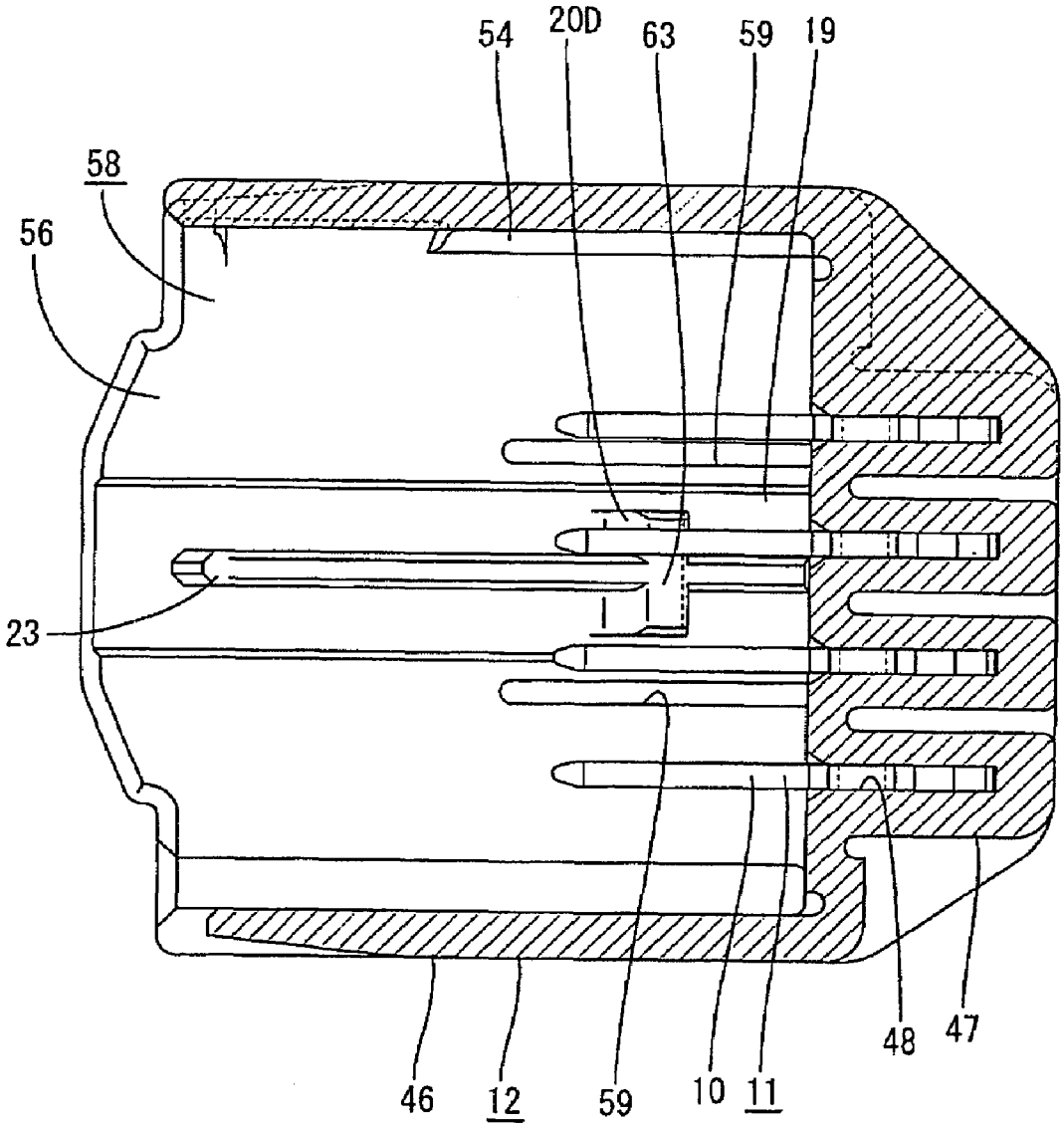
FIG. 22 is a section along A-A of FIG. 16.
Figure 23:
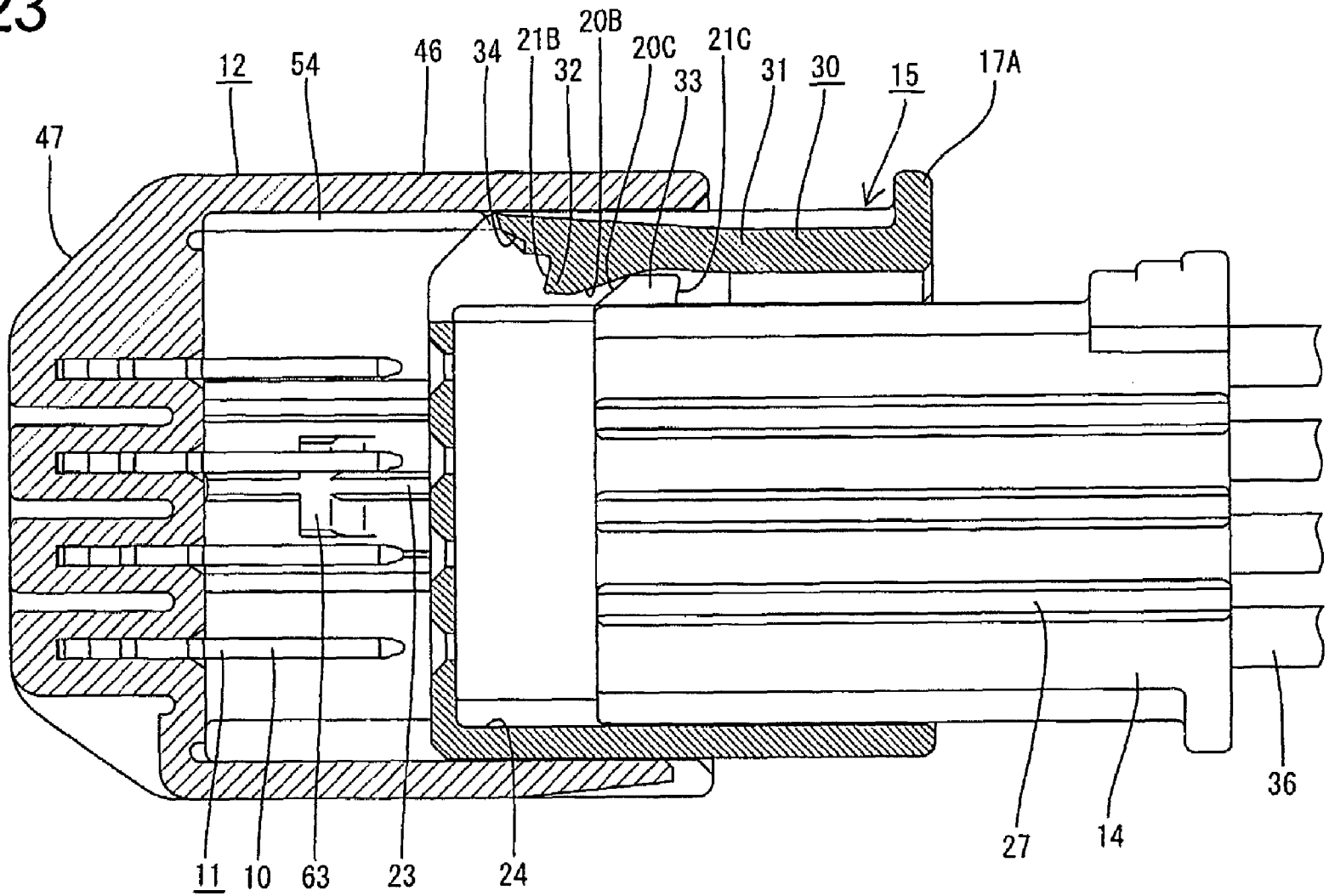
FIG. 23 is a side sectional view showing a partly connected state of the auxiliary connector where the partial connection detecting rib contacts a frame side lock.

As shown in FIGS. 21 and 22, partial connection detecting ribs 54 project down from the inner surface of the ceiling of the receptacle 46 and extend forward from the rear end of the ceiling wall to a position retracted slightly back from the front edge of the ceiling wall. The front ends of the partial connection detecting ribs 54 have a downward inclination toward the front. As shown in FIG. 23, the frame side lock 30 of the female frame 15 remains deformed up and out without being resiliently restored if the auxiliary connector 14 is left insufficiently fit into the female frame 15. An attempt could be made to fit the female frame 15 into the male housing 12 in this state. However, the front edge of the frame side lock 30 contacts the front edge of the partial connection detecting rib 54 that projects down and in from the ceiling wall of the receptacle 46 to hinder further insertion of the auxiliary connector 14. In this way, partial connection of the auxiliary connector 14 is detected. Further, the partial connection detecting ribs 54 reinforce the ceiling of the receptacle 46.

A bracket guide 56 bulges forward (rightward in FIG. 19) from the front edge of a lateral wall 58 of the receptacle 46 and functions to guide the bracket 16 to the guide rails 55.

Collision preventing ribs 23 extend in forward and backward directions FBD along intermediate positions of the inner surfaces of right and left walls 57, 58 of the receptacle 46, as shown in FIG. 16. The collision preventing ribs 23 fit in the guiding grooves 22 in the female frame 15 and prevent the female frame 15 from entering the receptacle 46 in a vertically inclined state that could cause the front end of the female frame 15 to contact the male tabs 10. Front edges of the collision preventing ribs 23 are inclined to fit easily into the guiding grooves 22. The collision preventing rib 23 on the right wall 57 in FIG. 16 extends back from the front edge of the right wall 57. However, the collision preventing rib 23 on the left wall 58 extends back from a position retracted from the front edge of the left wall 58 and substantially aligns with the front end of the collision preventing rib 23 of the right wall 57, as shown in FIG. 22. Thus, the female frame 15 cannot fit into the receptacle 46 in an inclined posture with respect to the width direction WD where one side of the female frame 15 precedes the other, thereby preventing the front end of the female frame 15 from contacting the male tabs 10.

Figure 19:
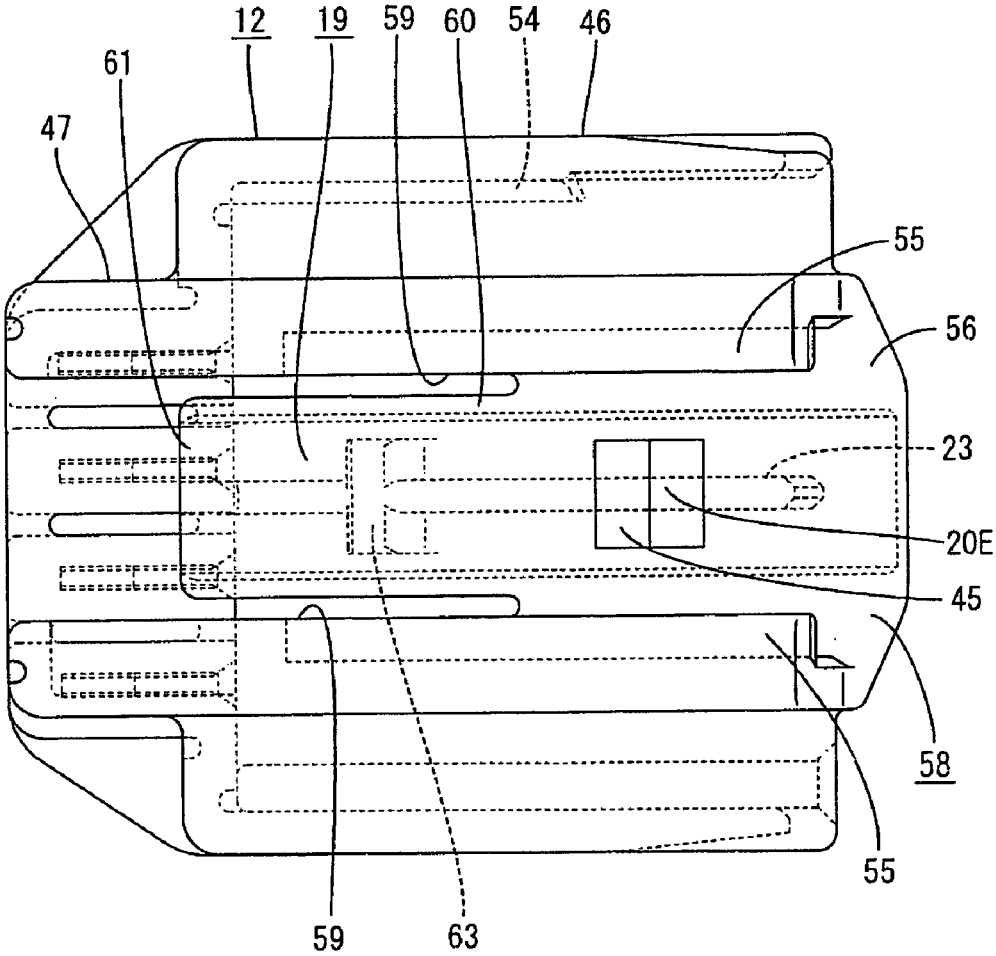
FIG. 19 is a left side view of the male housing.
Figure 20:
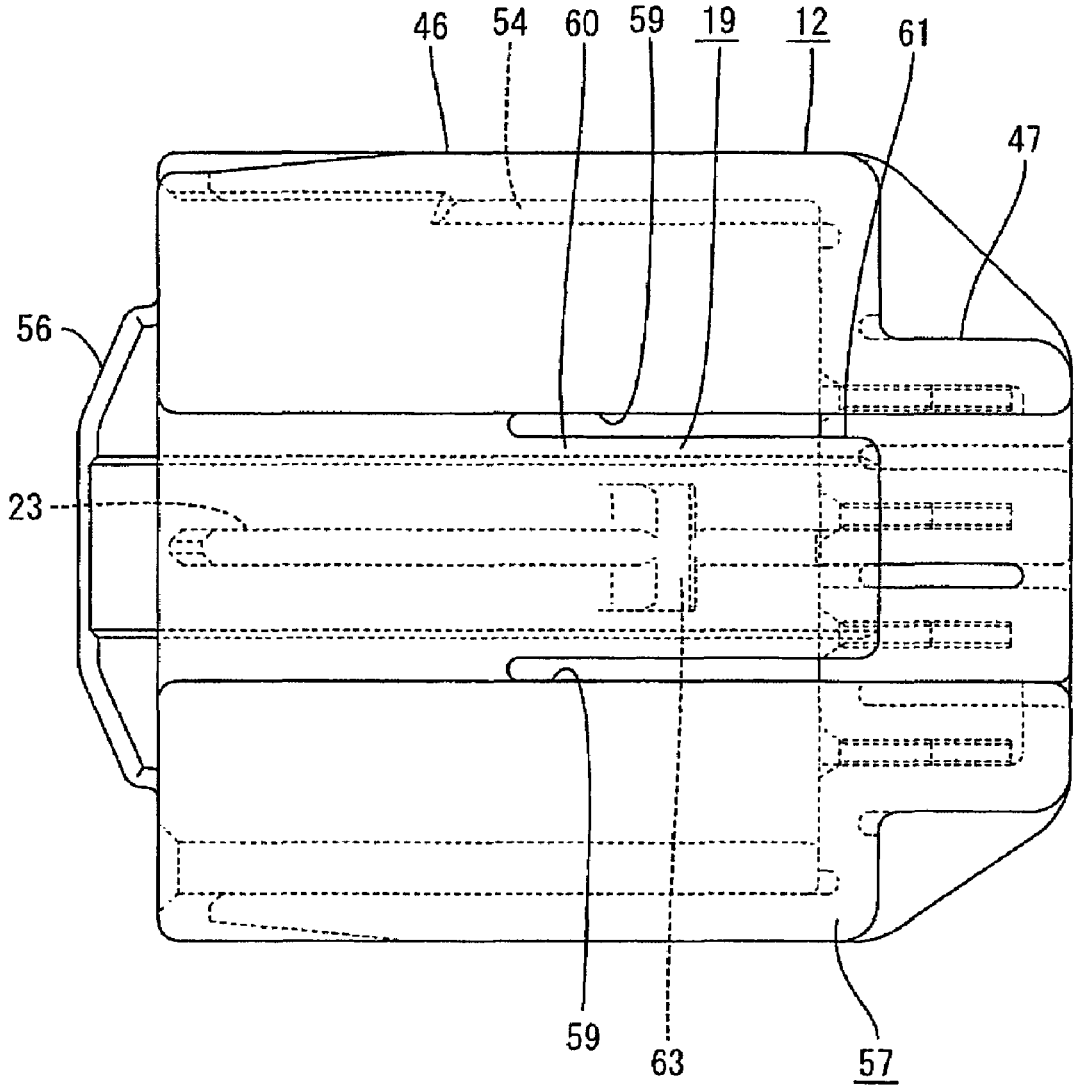
FIG. 20 is a right side view of the male housing.

As shown in FIGS. 19 and 20, two vertically spaced slits 59 are formed in intermediate positions of each of the right and left walls 57, 58 of the receptacle 46 and extend along the forward and backward directions FBD from the rear of the respective right and left walls 57, 58 to an intermediate position. A lock 19 is defined between the upper and lower slits 59 and is resiliently deformable out in the thickness direction of each of the respective walls 57, 58. The locks 19 engage the corresponding interlocking portion 18 of the female frame 15. The lock 19 in the right wall 57 extends back (right in FIG. 20) from a base end 60 to a free end 61. Further, the lock 19 in the left wall 58 extends back (left in FIG. 19) from a base end 60 to a free end 61 along an inserting direction ID of the bracket 16 into a clearance between the guide rails 55. Deformation areas 62 for the locks 19 are defined in spaces outside the locks 19 in the thickness direction of the right and left walls 57, 58 (space above the lock 19 in FIG. 5). A lock projection 63 projects in from the inner surface of each lock 19. An inclined surface 20D is defined at the front (right in FIG. 5) of the lock projection 63 so that the lock projection 63 can easily move onto the interlocking portion 18 of the female frame 15. A locking surface 21D is formed at the rear (left in FIG. 5) of the lock projection 63 and inclines slightly back towards its projecting end. The inclined surfaces 20A of the interlocking portions 18 of the female frame 15 slide in contact with the inclined surfaces 20D of the lock projections 63 of the locks 19 of the male housing 12 as the female frame 15 is fit into the receptacle 46 of the male housing 12. Accordingly, the locks 19 deform into the deformation areas 62. The lock projections 63 of the locks 19 move over the interlocking portions 18 of the female frame 15 when the female frame 15 reaches a properly inserted state and the locks 19 restore resiliently. As a result, the locking surfaces 21D of the locks 63 contact the locking surfaces 21A of the interlocking portions 18 of the female frame 15 to retain the female frame 15.

As shown in FIG. 22, the collision preventing ribs 23 extend on the inner surfaces of the locks 19 and reinforce the locks 19. The forcible collision preventing ribs 23 cross the lock projections 63 in forward and backward directions FBD at intermediate positions.

As shown in FIG. 19, two guide rails 55 project out from the outer surface of the left wall 58 of the receptacle 46 at positions above and below the lock 19. The guide rails 55 extend in the forward and backward directions FBD from positions near the front end of the left wall 58 to positions before the rear edge of the lock 19. As shown in FIG. 16, the guide rails 55 have substantially L-shaped cross sections when viewed from the front, and the bracket 16 can be inserted in the inserting direction ID into an area between the outer surface of the left wall 58 and surfaces of the guide rails 55 facing the left wall 58. The bracket 16 is stopped at a front end position in the inserting direction ID by the contact of the leading end of the bracket 16 with the back walls of the guide rails 55 (see FIG. 6).

As shown in FIG. 19, the engaging portion 45 projects out from the outer surface of the left wall 58 of the receptacle 46 (see FIG. 16) in an area between the upper and lower guide rails 55 and before (to the right in FIG. 19) the lock 19. The engaging portion 45 engages the locking section 44 of the bracket 16 for fixing the bracket 16 and the male housing 12 together. As shown in FIG. 5, an inclined surface 20E is formed at the front (right in FIG. 5) of the engaging portion 45 so that the bracket 16 can easily move thereon. However, a locking surface 21E is formed at the rear of the engaging portion 45 and is upright with respect to the outer surface of the left wall 42. The locking surface 21E of the engaging portion 45 contacts the opening edge of the locking section 44 of the bracket 16 from the front to retain the bracket 16.

As shown in FIG. 16, the height of the guide rails 55 from the outer surface of the left wall 58 exceeds the heights of the lock 19 and the engaging portion 45. Thus, the guide rails 55 protect the lock 19 and the engaging portion 45 from collision with external matter.

As shown in FIG. 6, the bracket 16 is dimensioned in forward and backward directions FBD to be in the deformation area 62 of the lock 19 when the bracket 16 is inserted between the guide rails 55 and the locking section 44 of the bracket 16 engages the engaging portion 45 of the male housing 12. The female frame 15 is locked doubly by the lock 19 and the bracket 16.

The connector is assembled by pushing the busbars 11 into the busbar holding grooves 48 of the male housing 12 from the front so that the fixing portions 50 of the busbars 11 are pressed into the fixing holes 51 of the busbar holding grooves 48. Thus, the busbars 11 are fixed in the busbar holding grooves 48 and the male tabs 10 thereof project into the receptacle 46.

Next, with the retainer 39 retracted from the retainer accommodating hole, the female terminal fittings 13 mounted at the ends of the wires 36 are inserted into the respective cavities 35 of the auxiliary connectors 14 from behind. As a result, the female terminal fittings 13 are retained by the auxiliary-connector side locks 40. The retainer 39 then is accommodated in the retainer accommodating hole to lock the female terminal fittings 13 redundantly.

Subsequently, the auxiliary connector 14 having the female terminal fittings 13 therein is inserted into each accommodating chamber 24 of the female frame 15 from behind. The inclined surface 20C of the partial lock 33 of the auxiliary connector 14 slides in contact with the inclined surface 20B of the locking projection 32 of the frame side lock 30 from behind during this inserting operation and, accordingly, the frame side lock 30 is deformed resiliently out and up. The locking projection 32 of the frame side lock 30 moves over the partial lock 33 of the auxiliary connector 14 when the auxiliary connector 14 is inserted properly. Thus, the frame side lock 30 is restored resiliently, and the locking surface 21B of the locking projection 32 of the frame side lock 30 contacts the locking surface 21C of the partial lock 33 of the auxiliary connector 14 from behind to prevent the auxiliary connector 14 from coming out backward. With the auxiliary connector 14 accommodated in the accommodating chamber 24 of the female frame 15, the rear end of the auxiliary connector 14 is exposed through the rear surface of the female frame 15 so that the wires 36 can be drawn rearwardly out of the auxiliary connector 14 (see FIG. 15).

The female frame 15 having the auxiliary connectors 14 accommodated therein then is fit into the receptacle 46 of the male housing 12. As a result, the collision preventing ribs 23 in the receptacle 46 of the male housing 12 enter the guiding grooves 22 in the female frame 15 to prevent the female frame 15 from being inserted into the receptacle in a vertically inclined state. Further, the collision preventing ribs 23 extend back from substantially transversely symmetrical positions of the right and left walls 57, 58 of the receptacle 46 to prevent the female frame 15 from being inserted into the receptacle 46 in a posture inclined so that one of the left and right sides of the front end of the female frame 15 precedes the other. In this way, the front end of the female frame 15 will not collide with the male tabs 10 projecting in the receptacle 46.

The inclined surfaces 20A of the interlocking portions 18 of the female frame 15 slide in contact with the inclined surfaces 20D of the lock projections 63 of the male housing 12 from the front as the female frame 15 is inserted into the receptacle 46. Accordingly, the locks 19 deform into the deformation areas 62. The lock projections 63 of the locks 19 move over the interlocking portions 18 of the female frame 15 when the female frame 15 is inserted properly. As a result, the locks 19 restore resiliently and the locking surfaces 21D of the lock projections 63 contact the locking surfaces 21A of the interlocking portions 18 of the female frame 15 to retain the female frame 15.

When the male housing 12 and the female frame 15 are connected properly, the male tabs 10 of the male housing 12 are inserted through the male tab insertion holes 28A of the female frame 15, through the male tab insertion holes 28B of the auxiliary connectors 14 and into the connecting tubes 38 of the female terminal fittings 13. Thus, the male tabs 10 are connected electrically with the female terminal fittings 13, and specified female terminal fittings 13 are shorted by the busbars 11.

The frame side lock 30 of the female frame 15 does not resiliently restore completely if the auxiliary connector 14 is fit only partly into the female frame 15, as shown in FIG. 23. An attempt could be made to connect the female frame 15 with the male housing 12 in this state. However, the front end of the still-deformed frame side lock 30 will contact the front end of the partial connection detecting rib 54 from the front to hinder the insertion of the auxiliary connector 14, thereby indicating the partial connection of the auxiliary connector 14. The front end of the frame side lock 30 preferably has a converging configuration (e.g. inclined back towards the bottom), whereas the front end of the partial connection detecting rib 54 has a converging configuration inclined in a substantially complementary manner (back toward the top) to the converging configuration of the partial connection detecting rib 54. Thus, if the front end of the frame side lock 30 and the front end of the partial connection detecting rib 54 contact each other, they slide in contact to engage the back sides of the mating parts. Therefore, the partly connected state can be detected.

The bracket 16 is inserted between the guide rails 55 of the male housing 12 when the male housing 12 and the female frame 15 are connected properly. First, the outer surface of the bracket guide 56 of the male housing 12 contacts the leading end of the bracket 16 to guide the bracket 16 into the clearance between the guide rails 55. The male housing 12 is pushed forward (rightward in FIG. 6) with the bracket 16 contacting the bracket guide 56. As a result, the leading end of the bracket 16 contacts the inclined surface 20E of the engaging portion 45 of the male housing 12 from the front. The bracket 16 then moves over the engaging portion 45 and is restored resiliently. As a result, the engaging portion 45 of the male housing 12 is fit into the locking section 44 of the bracket 16 to bring the locking surface 21E of the engaging portion 45 into contact with the opening edge of the locking section 44 of the bracket 16 from the front. In this way, the bracket 16 is locked. In this state, the leading end of the bracket 16 enters the deformation area 62 outside the lock 19 of the male housing 12 in the thickness direction of the left wall 58, thereby preventing the lock 19 from deforming into the deformation area 62. As a result, even if a force acts to separate the male housing 12 from the female frame 15, the lock 19 is prevented from deforming to disengage the lock projection 63 from the interlocking portion 18 of the female frame 15. Therefore, the male housing 12 and the female frame 15 can be locked together with an increased force.

The locks 19 extend back (leftward in FIG. 6) from the base ends 60 toward the free ends 61, and this extending direction is along the inserting direction ID (leftward in FIG. 6) of the bracket 16 into the clearance between the guide rails 16. The bracket 16 is inserted in the inserting direction ID between the guide rails 55 from the base end side of the lock 19. Thus, deformation of the base end of the lock 19 can be prevented more securely. As a result, the male housing 12 and the female frame 15 can be locked into each other with an even increased force.

The connector may have to be disassembled for maintenance. Thus, the bracket 16 is deformed out by an unillustrated jig to disengage the engaging portion 45 from the lock 44. The male housing 12 then is pulled back to separate the male housing 12 and the bracket 16 from each other.

Subsequently, the locks 19 are deformed into the deformation areas 62 by an unillustrated jig to disengage the locks 19 and the interlocking portions 18, and the male housing 12 and female frame 15 are pulled back away from each other to be separated. At this time, an operator can easily place his fingers on the finger placing portions 17A, 17B since the notches 52 are formed at the front edges of the ceiling wall and the bottom wall of the receptacle 46 of the male housing 12. The finger placing portions 17A, 17B of the female frame 15 are accommodated in the notches 52, and the finger placing slants 53A, 53B are formed on the outer or upper surface of the ceiling wall and on the outer or lower surface of the bottom wall. The operator can pull the female frame 15 back by placing his index finger and middle finger on the finger placing portions 17A on the ceiling wall and his thumb on the finger placing portion 17B on the bottom wall. Thus, forces can be exerted to the female frame 15 in a vertically well-balanced manner, which can improve operation efficiency.

The unillustrated disengagement jig can be inserted into the accommodating chamber 24 through an area of the female frame 15 before the frame side lock 30 so that the leading end of the jig contacts the disengagement recess 34 of the frame side lock 30 from the front. The jig deforms the frame side lock 30 up to disengage the locking projection 32 of the frame side lock 30 and the partial lock 33 of the auxiliary connector 14. Thus, the auxiliary connector 14 can be pulled back and separated from the female frame 15.

The retainer 39 of the auxiliary connector 14 is removed from the retainer accommodating hole by being swung out with the base end thereof as a support. Thus, the auxiliary-connector side locks 40 are pressed by an unillustrated jig to disengage the female terminal fittings 13, and the female terminal fittings 13 are pulled back to separate the auxiliary connector 14 and the female terminal fittings 13.

As described above, the bracket 16 is inserted between the guide rails 55 to engage the locking section 44 of the bracket 16 and the engaging portion 45 of the male housing 12 while the male housing 12 and the female frame 15 are connected properly. The bracket 16 enters the deformation space for the lock 19 and prevents the lock 19 from deforming. Thus, even if a force acts to separate the male housing 12 and the female frame 15, the lock 19 cannot deform in a direction to disengage from the interlocking portion 18. Therefore the male housing 12 and the female frame 15 are locked together with an increased locking force. Further, the bracket 16 is inserted between the guide rails 55 from the side of the base end 60 of the lock 19. Thus, the base end 60 of the lock 19 cannot deform. As a result, the male housing 12 and the female frame 15 are locked together with an even increased locking force.

The guide rails 55 of the male housing 12 are at the opposite sides of the lock 19 and the engaging portion 45. Additionally, the height of the guide rails 55 from the left wall 58 exceeds the heights of the lock 19 and the engaging portion 45 from the left wall 58. Thus, external matter is not likely to collide with the lock 19 and the engaging portion 45.

The collision preventing ribs 23 of the male housing 12 engage the guiding grooves 22 of the female frame 15 to prevent the female frame 15 from entering the receptacle 46 in an inclined posture. Thus, the male tabs 10 will not be broken by a forcible collision with the female frame 15. Further, the collision preventing ribs 23 extend to the inner surfaces of the locks 19 and hence reinforce the locks 19. Thus, the connector can be made smaller as compared to a case where ribs are provided separately to reinforce the locks 19.

Figure 24:
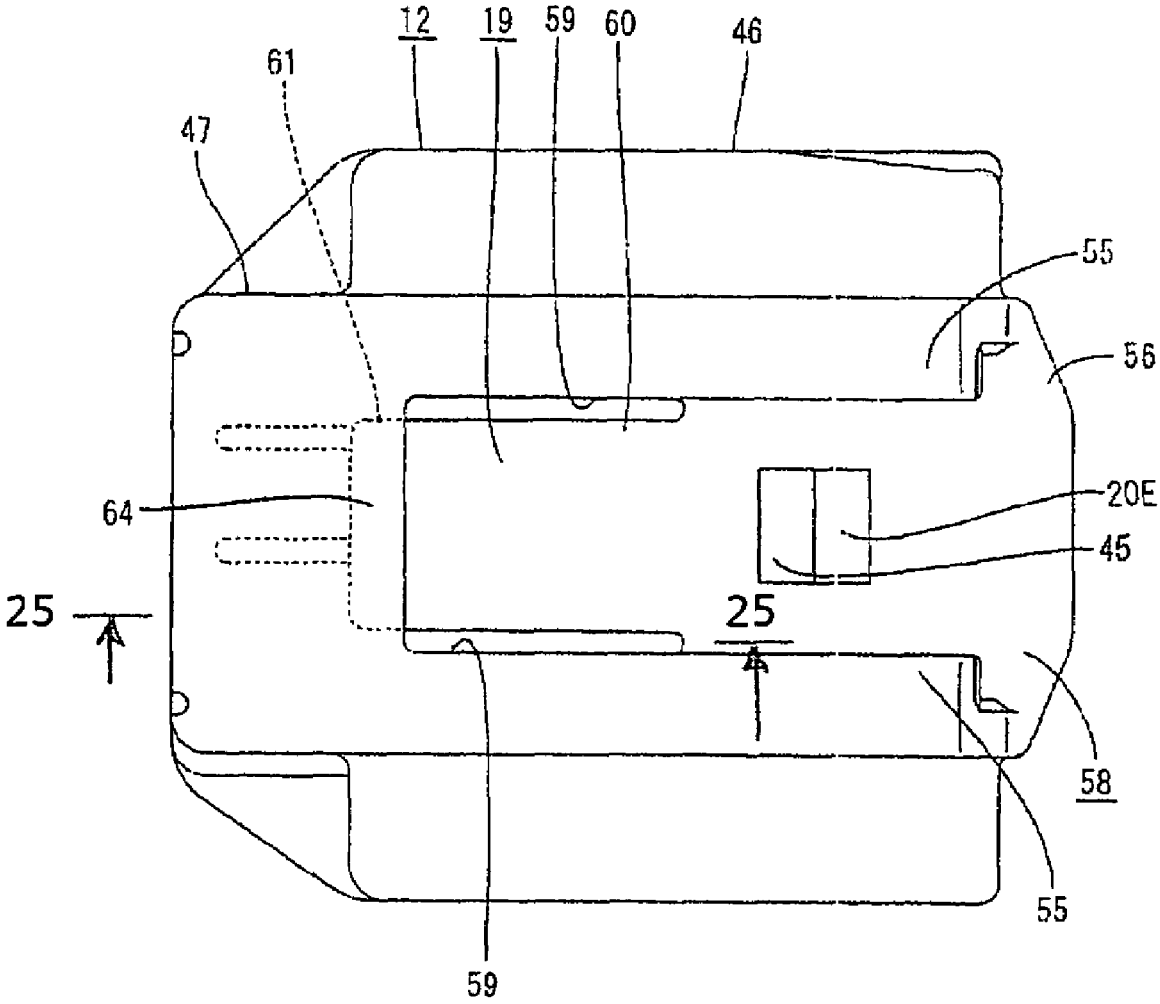
FIG. 24 is a left side view of a male housing of a second embodiment.
Figure 25:
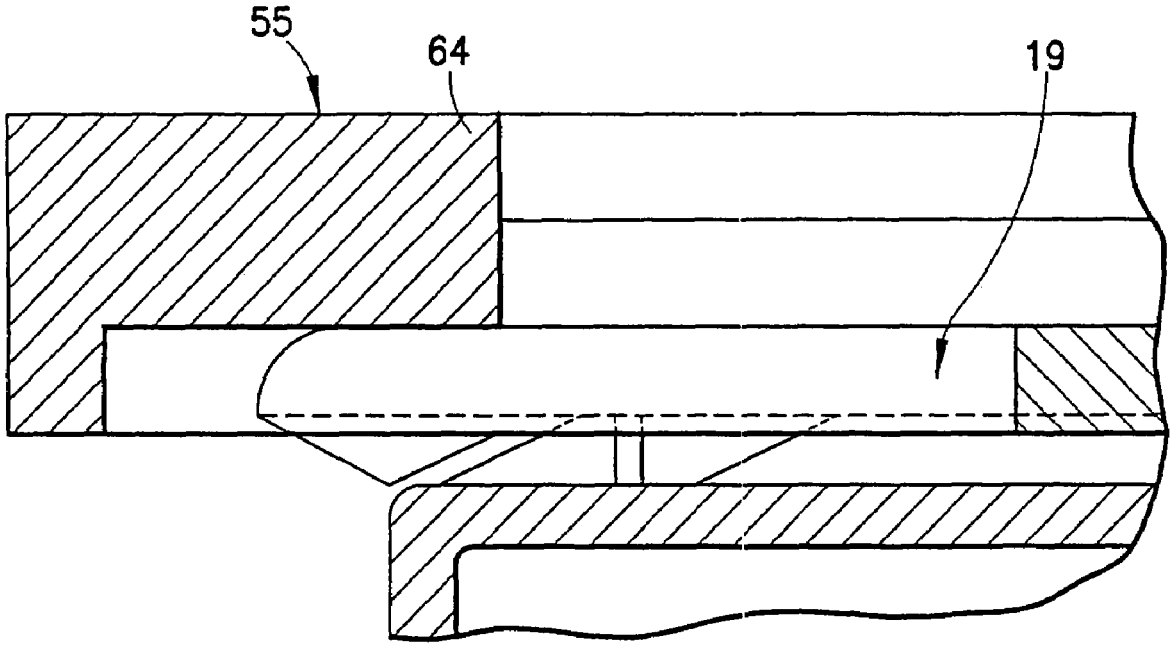
FIG. 25 is a cross-sectional view taken along line 25-25 in FIG. 24.

A second embodiment of the invention is shown in FIG. 24. In this embodiment, an excessive deformation preventing piece 64 spans between rear ends of the two guide rails 55 and at least partly covers the rear end of the lock 19 from the outside. Other parts of the connector of the second embodiment are similar to the first embodiment. These similar parts are identified by the same reference numerals, but are not described again.

The female frame 15 could be fit into the receptacle 46 of the male housing 12 in an oblique posture. As a result, the outer wall of the female frame 15 could push and excessively deform the lock 19. A plastically deformed lock 19 may not engage the interlocking portion 18 completely. Thus, a connecting force of the female frame 15 and the male housing 12 may be low.

The excessive deformation preventing piece 64 at least partly covers the lock 19 from the outer side in this embodiment. Thus, even if the lock 19 is pushed out by an excessive force, an excessive deformation of the lock 19 is prevented by the contact of the excessive deformation preventing piece 64 with the lock 19 from the outer side. Therefore, a reduction in the connecting force of the female frame 15 and the male housing 12 can be prevented.

The invention is not limited to the above described and illustrated embodiments. For example, the following embodiments are also embraced by the invention defined by the claims. Other changes can be made without departing from the scope and spirit of the invention as defined by the claims.

The guide rails 55 extend in forward and backward directions FBD in the foregoing embodiments. However, the guide rails 55 may extend in any direction along the outer surface of any wall of the connector.

The guide rails 55 are at opposite sides of both the engaging portion 45 and the lock 19 in the foregoing embodiments. However, the guide rails 55 need not be at the opposite sides of the engaging portion 45 if the engaging portion 45 is at a position not likely to be collided by external matter.

The bracket 16 is inserted between the guide rails 55 from the side of the base end 60 of the lock 19 in the foregoing embodiments. However, the bracket 16 may be inserted between the guide rails 55 from the side of the free end 61 of the lock 19. Thus, the leading end of the bracket 16 will contact the free end 61 of the lock 19 located on the interlocking portion 18 if the housings are left partly connected, so that partial connection can be detected.

The excessive deformation preventing piece 64 can be omitted e.g. if the rigidity of the locks 19 is increased to eliminate the likelihood of excessively deforming the lock 19.

The collision preventing ribs 23 may be formed in areas other than the inner surfaces of the locks 19 e.g. if the rigidity of the locks 19 is increased.

The guide rails 55 are on the male housing 12 in the foregoing embodiment. However, the guide rails 55 can be omitted, for example, if the bracket 16 is formed with a through hole as a locking section, the male housing 12 is formed with an engaging portion in the form of a split pin, the bracket 16 is fit to the side wall of the male housing from the outer side in the thickness direction of this side wall to pass the engaging portion through the locking section, and the male housing 12 and the bracket 16 are engaged by the contact of the engaging portion with the bracket 16 from the outer side.

The male housing 12 has the busbars 11 in the foregoing embodiments. However, the male housing 12 may have male terminal fittings. Further, a female housing with female terminal fittings may be the outer housing, and a male housing with male terminal fittings may be the inner housing. There is no restriction as to which of male and female housings is the outer housing provided that the housings are connected one inside the other.

What is claimed is:

1. A connector, comprising:

an outer housing having opposite front and rear ends and a side wall extending rearwardly from the front end, at least one engaging portion projecting out from the side wall, at least one lock formed at the side wall rearward of the engaging portion and being resiliently deformable in a thickness direction of the side wall into a deformation area adjacent the outer surface of the side wall, two guide rails formed on the side wall, projections formed on the respective guide rails and projecting towards one another at positions spaced outwardly from the outer surface of the side wall;

an inner housing connectable at least partly inside the outer housing so that the lock is at an outer side of the inner housing in a properly connected state of the housings, the inner housing having at least one interlocking portion at the outer side of the inner housing and being engageable with the lock to hold the housings together; and a bracket being inserted between the outer surface of the side wall and the projections of the guide rails and into the deformation area for the lock, the bracket having at least one locking section engageable with the engaging portion at the side wall of the outer housing for holding a portion of the bracket in the deformation area for the lock and holding the lock engaged with the interlocking portion of the inner housing.

2. The connector of claim 1, wherein the guide rails are formed on the side wall of the outer housing at opposite sides of the lock and the engaging portion, the guide rails extending substantially in an inserting direction of the bracket, the bracket being insertable between the guide rails.

3. The connector of claim 2, wherein a projecting distance of the guide rails from the side wall exceeds projecting distances of the lock and the engaging portion from the side wall.

4. The connector of claim 1, wherein the lock is formed between slits in the side wall of the outer housing and is cantilevered to extend along an inserting direction of the bracket.

5. The connector of claim 1, wherein at least one excessive deformation preventing piece is provided on the side wall at a position spaced outwardly from a portion of the lock for preventing an excessive deformation of the lock.

6. The connector of claim 5, wherein the excessive deformation preventing piece is formed to span between the guide rails at a position outwardly from the lock.

7. A connector, comprising:

an outer housing having a side wall, at least one lock formed at the side wall and being resiliently deformable in a thickness direction of the side wall into a deformation area and at least one engaging portion formed at the side wall;

an inner housing connectable at least partly inside the outer housing so that the lock is at an outer side in a properly connected state of the housings, the inner housing having at least one interlocking portion engageable with the lock to hold the housings together;

a bracket being inserted into the deformation area for the lock, the bracket having at least one locking section engageable with the engaging portion at the side wall of the outer housing wherein at least one collision preventing rib is formed on an inner surface of the side wall of the outer housing, the collision preventing rib projecting inward in the thickness direction of the side wall and extending forward from a connection surface of the outer housing with the inner housing along a connecting direction, the collision preventing rib being engageable with at least one guiding groove formed in an outer surface of a side wall of the inner housing and extending substantially up to an inner surface of the lock.

8. The connector of claim 1, wherein the inner housing comprises a frame and at least one auxiliary connector insertable into the frame.

9. A connector, comprising:

an outer housing having a side wall, at least one lock formed at the side wall and being resiliently deformable in a thickness direction of the side wall into a deformation area and at least one engaging portion formed at the side wall;

an inner housing connectable at least partly inside the outer housing so that the lock is at an outer side in a properly connected state of the housings, the inner housing having at least one interlocking portion engageable with the lock to hold the housings together, the inner housing having a frame and at least one auxiliary connector insertable into the frame;

a bracket being inserted into the deformation area for the lock, the bracket having at least one locking section engageable with the engaging portion at the side wall of the outer housing; and at least one partial connection detector for detecting a partial connection of the auxiliary connector and the inner housing.

10. The connector of claim 1, wherein the inner housing has finger placing portions for operating the inner housing and wherein the outer housing has notches for receiving the finger placing portions of the inner housing.

* * * * *